US011149432B2

(12) United States Patent
Gatland et al.

(10) Patent No.: US 11,149,432 B2
(45) Date of Patent: Oct. 19, 2021

(54) SYSTEM, METHOD AND APPARATUS FOR SUBSTANTIALLY AIRTIGHT AREA SEPARATION WALL

(71) Applicant: CERTAINTEED GYPSUM, INC., Malvern, PA (US)

(72) Inventors: Stanley D. Gatland, Downingtown, PA (US); Todd P. Dinoia, Littleton, MA (US); Conor Patrick McDonald, Cleveland, OH (US)

(73) Assignee: CERTAINTEED GYPSUM, INC., Malvern, PA (US)

( * ) Notice: Subject to any disclaimer, the term of this patent is extended or adjusted under 35 U.S.C. 154(b) by 0 days.

(21) Appl. No.: 16/785,001

(22) Filed: Feb. 7, 2020

(65) Prior Publication Data

US 2020/0173167 A1 Jun. 4, 2020

Related U.S. Application Data

(62) Division of application No. 15/382,525, filed on Dec. 16, 2016, now abandoned.

(Continued)

(51) Int. Cl.
*E04B 1/94* (2006.01)
*E04C 2/04* (2006.01)

(Continued)

(52) U.S. Cl.
CPC ..... *E04B 1/942* (2013.01); *E04B 1/24* (2013.01); *E04B 1/6108* (2013.01); *E04B 2/02* (2013.01);

(Continued)

(58) Field of Classification Search
CPC ..... E04B 1/942; E04B 1/24; E04B 1/6108; E04B 2/02; E04B 2/723;

(Continued)

(56) References Cited

U.S. PATENT DOCUMENTS 3,305,993 A 2/1967 Nelsson
3,553,915 A 1/1971 Passovoy (Continued)

FOREIGN PATENT DOCUMENTS

GB 2426300 B ‡ 3/2010 ..... H02G 3/0412
GB 2426300 B 3/2010

(Continued)

OTHER PUBLICATIONS

Field Testing of Compartmentalization Methods for Multifamily Construction, Building America Case Study: Technology Solutions for New and Existing Homes, Jan. 2015, 2 pages, US Department of Energy, US.‡

(Continued)

*Primary Examiner* — Theodore V Adamos
(74) *Attorney, Agent, or Firm* — Abel Schillinger, LLP; Thomas H. Osborn

(57) ABSTRACT

An area separation wall (ASW) may include gypsum liner panels and structural elements located between adjacent ones of the gypsum liner panels. A sealing material may be located between the gypsum liner panels and the structural elements, and between adjacent ones of the structural elements. The sealing material may form seals therebetween, such that the ASW is substantially airtight when assembled. In addition, the ASW may include a fire rating of at least 2 hours in compliance with ANSI/UL 263.

18 Claims, 21 Drawing Sheets

Related U.S. Application Data

(60) Provisional application No. 62/269,815, filed on Dec. 18, 2015.

(51) Int. Cl.

| | |
|---|---|
| ***E04B 1/24*** | (2006.01) |
| ***E04B 1/61*** | (2006.01) |
| ***E04B 2/02*** | (2006.01) |
| ***E04B 2/72*** | (2006.01) |
| ***E04C 2/52*** | (2006.01) |

(52) U.S. Cl.
CPC ..... *E04B 2/723* (2013.01); *E04C 2/04* (2013.01); *E04C 2/043* (2013.01); *E04C 2/52* (2013.01); *E04B 2001/2481* (2013.01); *E04B 2002/0202* (2013.01)

(58) Field of Classification Search
CPC ..... E04B 2001/2481; E04B 2002/0202; E04C 2/04; E04C 2/52; E04C 2/043
See application file for complete search history.

(56) References Cited

U.S. PATENT DOCUMENTS

| | | | | |
|---|---|---|---|---|
| 3,611,653 | A | 10/1971 | Zinn | |
| 3,974,607 | A ‡ | 7/1976 | Balinski | E04B 1/941 52/232 |
| 4,069,639 | A * | 1/1978 | Lindner | E04B 2/7457 52/745.1 |
| 4,152,873 | A ‡ | 5/1979 | Burke | E04B 1/76 52/1 |
| 4,464,877 | A | 8/1984 | Gebhardt et al. | |
| 5,092,100 | A | 3/1992 | Lambert et al. | |
| 5,127,203 | A ‡ | 7/1992 | Paquette | E04B 2/822 52/241 |
| 5,353,561 | A ‡ | 10/1994 | Menchetti | E04B 2/7453 52/241 |
| 6,006,484 | A * | 12/1999 | Geissbuhler | E04B 2/7409 52/479 |
| 6,367,212 | B1 | 4/2002 | Manning | |
| 7,866,108 | B2 ‡ | 1/2011 | Klein | E04B 2/7457 52/481 |
| 8,782,977 | B2 ‡ | 7/2014 | Burgess | E04B 2/00 52/235 |
| 8,826,599 | B2 ‡ | 9/2014 | Stahl, Jr. | E04B 1/941 52/1 |
| 9,045,899 | B2 ‡ | 6/2015 | Pilz | E04B 2/7411 |
| 2005/0183361 | A1 | 8/2005 | Frezza | |
| 2007/0094992 | A1 | 5/2007 | Antonic | |
| 2008/0047225 | A1 | 2/2008 | Kawai et al. | |
| 2009/0049781 | A1 * | 2/2009 | Pilz | E04C 3/04 52/481.1 |
| 2009/0107064 | A1 ‡ | 4/2009 | Bowman | E04B 1/26 52/238 |
| 2010/0186325 | A1 ‡ | 7/2010 | Klein | E04B 2/7457 52/232 |
| 2011/0197530 | A1 * | 8/2011 | Bahnmiller | B32B 5/245 52/309.4 |
| 2013/0111840 | A1 | 5/2013 | Bordener | |
| 2013/0118102 | A1 | 5/2013 | Pilz et al. | |
| 2015/0275510 | A1 ‡ | 10/2015 | Klein | E04B 2/7457 52/232 |
| 2015/0354210 | A1 ‡ | 12/2015 | Stahl, Jr. | E04B 2/7409 277/64 |

FOREIGN PATENT DOCUMENTS

| | | | | |
|---|---|---|---|---|
| WO | 2009026464 | A1 | 2/2009 | |
| WO | WO-2009026464 | A1 ‡ | 2/2009 | |
| WO | 2017106785 | A1 | 6/2017 | |
| WO | WO-2017106785 | A1 ‡ | 6/2017 | E04B 1/24 |

OTHER PUBLICATIONS

Code Challenges with Multi-Family Area Separation Walls, Building America Focus Meeting notes, Sep. 29, 2015, 10 pages, US.‡
International Search Report and Written Opinion for PCT Application No. PCT/US2016/067376, dated Apr. 14, 2017, 11 pages.‡
Residential Pressure and Air Leakage, Energy Door Fan Manual, 2017, 72 pages, Retrotec.‡
Air Leakage Control in Multi-Unit Residential Buildings, RDH Building Engineering LTD., Apr. 2, 2013, 136 pages, CA.‡
BlazeFrame Product Catalog, Sep. 10, 2012, 16 pages, ClarkDietrich Building Systems, West Chester US.‡
The Air Barrier System, ABAA Master, Sep. 4, 2009, 8 pages, Air Barrier Association of America, US.‡
The Air Barrier System, ABAA Master, Sep. 4, 2009, 7 pages, Air Barrier Association of America, US.
Building Science Corporation, "Info-401: Air Barries—Airtight Drywall Approach," May 20, 2009, https://buildingscience.com/documents/information-sheets/air-barriers-airtight-drywall-approach, (last accessed on Feb. 7, 2020), 6 pages.
Weston, Theresa, "Enclosure Air Leakage Testing: What's New and What's Coming?," RESNET Annual Conference, Feb. 26, 2014, 68 pages.
CGC, A USG Complany, Gypsum Fire Wall Systems, SA-925, 2004, 16 pages.
USG, Sheetrock Brand Acoustical Sealant, Submittal Sheet 09250, 2011, 2 pages.

* cited by examiner
‡ imported from a related application

SYSTEM, METHOD AND APPARATUS FOR SUBSTANTIALLY AIRTIGHT AREA SEPARATION WALL

CROSS-REFERENCE TO RELATED APPLICATION(S)

This application is a divisional of and claims priority under 35 U.S.C. § 120 to U.S. patent application Ser. No. 15/382,525, entitled "SYSTEM, METHOD AND APPARATUS FOR SUBSTANTIALLY AIRTIGHT AREA SEPARATION WALL," by Stanley D. GATLAND et al., filed Dec. 16, 2016, which claims priority under 35 U.S.C. § 119(e) to U.S. Patent Application No. 62/269,815, entitled "SYSTEM, METHOD AND APPARATUS FOR SUBSTANTIALLY AIRTIGHT AREA SEPARATION WALL," by Stanley D. GATLAND et al., filed Dec. 18, 2015, all of which are assigned to the current assignee hereof and incorporated herein by reference in their entireties.

BACKGROUND OF THE INVENTION

Field of the Disclosure

The present invention relates in general to gypsum panels and, in particular, to a system, method and apparatus for a substantially airtight, area separation wall.

Description of the Related Art

Area separation walls (ASW) or "party walls" are required by building codes between units in multifamily buildings. ASW are designed to achieve a 2-hour fire resistance rating using ANSI/UL 263. Conventional ASW assemblies include two layers of 1-inch gypsum panels that are friction fit into 25 MSG steel C-tracks and H-channels. ASWs are considered fire resistant, but not air tight. Such ASW construction techniques allow significant air flow to occur between dwellings, as well as the outdoor environment.

Several code and program requirements are driving the need for easier and more effective methods of compartmentalization that also meet code fire safety requirements. For example, the 2012 International Energy Conservation Code (IECC) requires airtightness of 3 ACH50 test pressure for single-family and multifamily construction in climate zones 3-8. Leadership in Energy & Environmental Design (LEED) has a similar compartmentalization requirement, as does ASHRAE Standard 189. ASHRAE Standard 62.2, which has an exceptionally stringent compartmentalization requirement, will soon be responsible for all low-rise and high-rise multifamily ventilation requirements. Current fire-resistance rated (or area separation) wall assemblies present a great challenge in air sealing and compartmentalization, particularly in townhouse construction. Since conventional solutions make achieving the new whole-building air tightness requirement very difficult, improvements in ASW continue to be of interest.

SUMMARY

Embodiments of a system, method and apparatus for a substantially airtight, area separation wall (ASW) are disclosed. For example, the ASW may include gypsum liner panels and structural elements located between adjacent ones of the gypsum liner panels. A sealing material may be located between the gypsum liner panels and the structural elements, and between adjacent ones of the structural elements. The sealing material may form seals therebetween, such that the ASW is substantially airtight when assembled. In addition, the ASW may include a fire rating of at least 2 hours in compliance with ANSI/UL 263.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
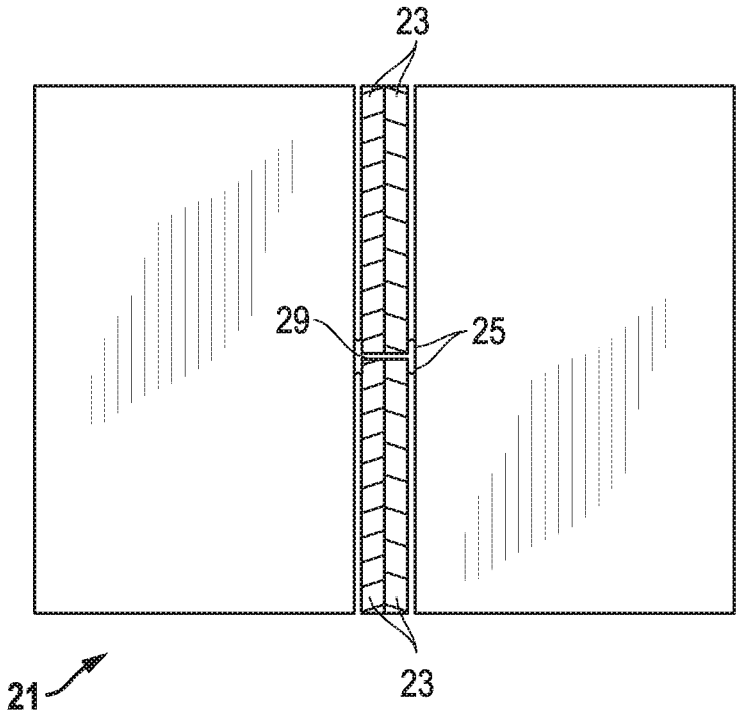
FIG. 1 is a schematic drawing of a multi-family dwelling having two home units, and an embodiment of an area separation wall (ASW) therebetween.
Figure 2:
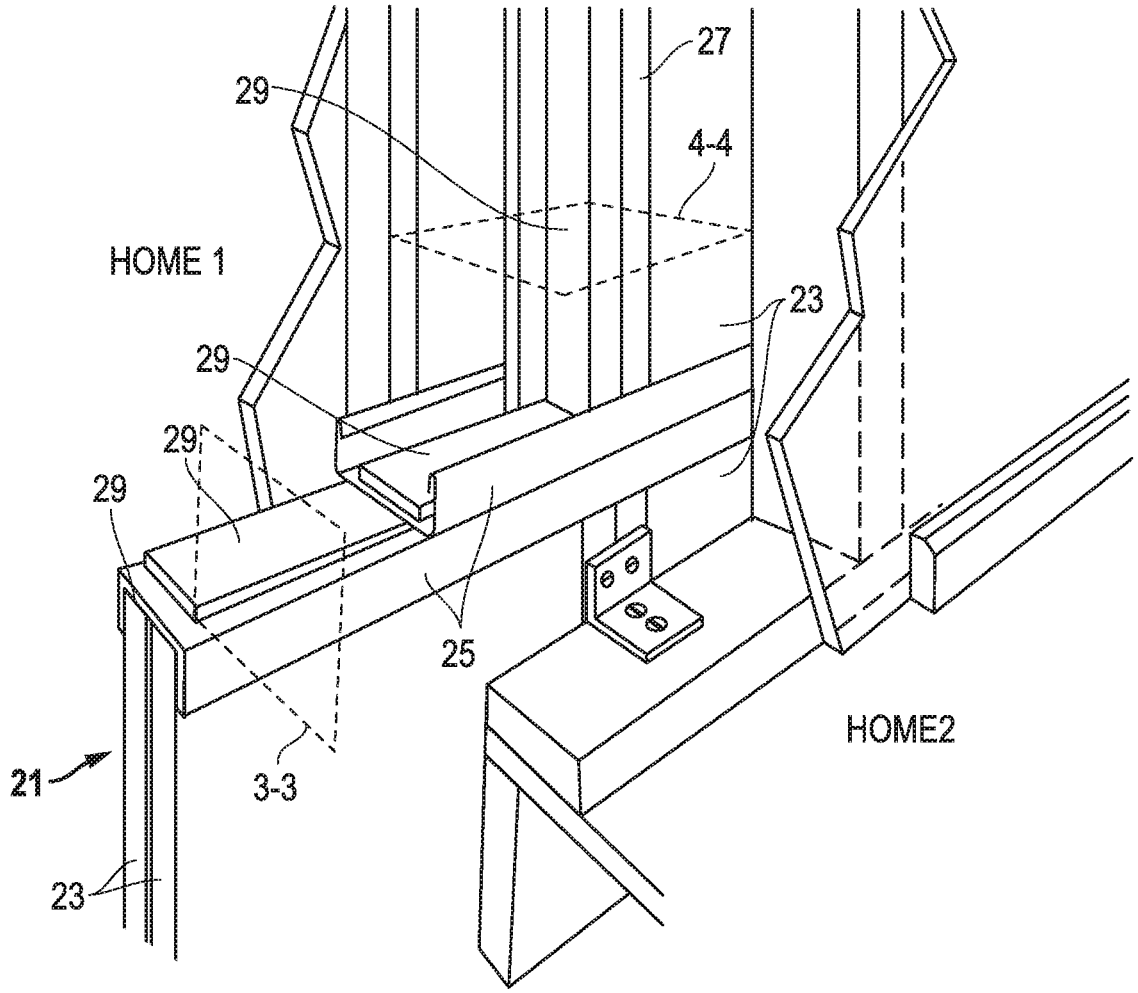
FIG. 2 is an enlarged, isometric view of the multi-family dwelling and home units of FIG. 1, with the embodiment of the ASW therebetween.

Embodiments of a system, method and apparatus for a substantially airtight, area separation wall (ASW) are disclosed. For example, FIGS. 1 and 2 schematically illustrate an embodiment of an ASW 21 for improving fire protection for a multi-family dwelling having two very closely adjacent homes. The ASW 21 may act as a fire resistant partition between the homes, and may include a plurality of gypsum liner panels 23, and a plurality of structural elements 25, 27 therebetween. Each gypsum liner panel 23 is specifically designed for use in the ASW 21, rather than for typical interior walls. Gypsum liner panels 23 are usually thicker (e.g., about 1-inch thick, rather than ⅝-inches thick) and more fire resistant than conventional gypsum interior wall panels.

Although two types of structural elements 25, 27 are shown, the ASW 21 may have more or fewer types of structural elements. In one version, structural element 25 may include an elongated track with a generally C-shaped sectional profile, while structural element 27 may include an elongated track with a generally H-shaped sectional profile. Structural elements 25, 27 may be formed from a rigid material, such as steel.

In addition, embodiments of the ASW 21 may include sealing material 29 located between the gypsum liner panels 23 and the structural elements 25, 27. The sealing material 29 also may be located between adjacent ones of the structural elements 25, 27. Versions of the sealing material 29 may form seals between these components such that the ASW 21 is substantially airtight when assembled. Moreover, embodiments of the ASW 21 may include a fire rating of at least 2 hours in compliance with ANSI/UL 263. In other versions, the fire rating of the ASW 21 can be at least about 2.25 hours, or even at least about 2.5 hours.

In some embodiments, the term "substantially airtight" may be defined as an air permeance of not greater than 0.04 cfm/ft$^2$ under a pressure differential of 0.3 in water (1.57 psf) (0.2 L/s·m$^2$ @ 75 Pa) when tested with the method prescribed by ASTM E2357, Specimen 1, after the ASW 21 is assembled. These tests are in compliance with the Air Barrier Association of America (ABAA) Section 01 41 00.

In other embodiments, the sealing material 29 may include an air permeance of not greater than 0.004 cfm/ft$^2$ under a pressure differential of 0.3 in water (1.57 psf) (0.02 L/s·m$^2$ @ 75 Pa) when tested in accordance with ASTM E2178, when the ASW 21 is assembled.

For some embodiments of the claimed invention, the following table may be used to convert between the English system and the metric system, as well as between testing at different pressures. One basis for calculating this table may be found at the following website, which is incorporated therein by reference in its entirety. http://retrotec.com/sites/default/files/manual-guides-specs/Manual-Residential%20Pressure%20%26%20Air%20Leakage%20Testing.pdf.

TABLE 1

Air Leakage Rate Conversion Table - 50 Pa to 75 Pa
$Q_2 = Q_1 (\Delta P_2/\Delta P_1)^n$; where n = 0.65
Q1 = CFM50/sf
$\Delta P_1$ = 50 Pa
$\Delta P_2$ = 75 Pa

| ACH50 (unitless) | Q1 @50 Pa (cfm/ft$^2$) | Conversion Factor $(\Delta P_2/\Delta P_1)^n$ (unitless) | Q2 @75 Pa $Q_2 = Q_1 (\Delta P_2/\Delta P_1)^n$ (cfm/ft$^2$) | Q2 @75 Pa (L/s m$^2$) |
|---|---|---|---|---|
| 0.6 | 0.03 | 1.30 | 0.04 | 0.20 |
| 1.5 | 0.07 | 1.30 | 0.09 | 0.46 |
| 2.0 | 0.10 | 1.30 | 0.13 | 0.66 |
| 2.5 | 0.13 | 1.30 | 0.17 | 0.86 |
| 2.8 | 0.14 | 1.30 | 0.18 | 0.93 |
| 3.0 | 0.14 | 1.30 | 0.18 | 0.93 |
| 3.5 | 0.17 | 1.30 | 0.22 | 1.12 |
| 4.0 | 0.19 | 1.30 | 0.25 | 1.26 |
| 4.3 | 0.21 | 1.30 | 0.27 | 1.39 |
| 4.6 | 0.23 | 1.30 | 0.30 | 1.52 |
| 4.7 | 0.23 | 1.30 | 0.30 | 1.52 |
| 5.0 | 0.24 | 1.30 | 0.31 | 1.59 |
| 5.2 | 0.25 | 1.30 | 0.33 | 1.65 |
| 6.0 | 0.29 | 1.30 | 0.38 | 1.92 |
| 7.0 | 0.34 | 1.30 | 0.44 | 2.25 |
| 10.0 | 0.49 | 1.30 | 0.64 | 3.24 |

For some embodiments, the following data measurements for a pressurization test CFM @ 50 Pa was collected on the various sealing materials 29 used as shown in Table 2. For some embodiments, the following data measurements for a depressurization test CFM @ 50 Pa was collected on the various sealing materials 29 used as shown in Table 3. In some embodiments, the sealing material 29 may be a flexible flashing tape which may be 3M®-8067 or another type. In some embodiments, the sealing material 29 may be a compressed gasket pressure sensitive foam tape which may be Norseal® V734 or another type. In some embodiments, the sealing material 29 may be a friction fit. In some embodiments, the sealing material 29 may be latex caulk applied only in the c-channels. In some embodiments, the sealing material 29 may be latex caulk applied in all channels. In some embodiments, the sealing material 29 may be a water activated adhesive which may be Hydrotrim® or another type.

TABLE 2

Measurements of Pressurization based on Sealing Material

| Test | Sealing material | Surface area of test assembly (ft2) | Baseline (chamber without ASW area) | uncertainty (%) | Total (chamber including ASW area) | uncertainty |
|---|---|---|---|---|---|---|
| 1 | Flexible Flashing Tape | 70 | 27.75 | 1.50 | 27.895 | 0.00 |
| 2 | Compressed Gasket Pressure Sensitive Foam Tape | 71 | 29.201 | 1.5 | 29.75 | 0.5 |
| 3 | Friction-fit | 70 | 29.824 | 0.5 | 78.63 | |
| 4 | Latex Caulk - only c-channels | 70 | 29.824 | 0.6 | 30.512 | 0.6 |
| 4 | Latex Caulk - all channels | 70 | 29.824 | 1.4 | 29.241 | 0.9 |
| 5 | Water Activated Adhesive | 67.5 | 26.619 | 0.7 | 26.291 | 0.9 |

TABLE 3

Measurements of Depressurization based on Sealing Material

| Test | Sealing material | Surface area of test assembly (ft2) | Baseline (chamber without ASW area) | uncertainty | Total (chamber including ASW area) | uncertainty |
|---|---|---|---|---|---|---|
| 1 | Flexible Flashing Tape | 70 | 29.565 | 1.5 | 30.724 | 0.5 |
| 2 | Compressed Gasket Pressure Sensitive Foam Tape | 71 | 29.304 | 0.3 | 32.742 | 0.3 |
| 3 | Friction-fit | 70 | 27.354 | 0.4 | 73.14 | |
| 4 | Latex Caulk - only c-channels | 70 | 27.354 | 0.4 | 32.146 | 0.8 |
| 4 | Latex Caulk - all channels | 70 | 27.354 | 0.4 | 30.637 | 0.7 |
| 5 | Water Activated Adhesive | 67.5 | 27.563 | 0.1 | 29.286 | 0.4 |

For some embodiments, the following data calculations were done for measuring air-tightness of the various sealing materials 29 used as shown in Table 4.

TABLE 4

Calculations of Air-Tightness based on Sealing Material

| Test | Sealing material | Surface area of test assembly (ft2) | ASW (Total - Baseline)CFM @50 Pa | Q50 (CFM50/ft2) | ACH50(refer to conversion Table) |
|---|---|---|---|---|---|
| 1 | Flexible Flashing Tape | 70 | 1.159 | 0.017 | <0.6 |
| 2 | Compressed Gasket Pressure Sensitive Foam Tape | 71 | 3.438 | 0.048 | 1 |
| 3 | Friction-fit | 70 | 45.786 | 0.654 | >10 |
| 4 | Latex Caulk - only c-channels | 70 | 4.792 | 0.068 | 1.5 |
| 4 | Latex Caulk - all channels | 70 | 3.283 | 0.047 | 1 |
| 5 | Water Activated Adhesive | 67.5 | 1.723 | 0.026 | <0.6 |

Table 4 indicates that the flexible flashing tape, the compressed gasket pressure sensitive foam tape, the latex caulk in the c-channels, the latex caulk in all channels, and the water activated adhesive are substantially airtight under Table 1.

Embodiments of the sealing material 29 may be configured in numerous constructions, properties and configurations. In some versions, the sealing material 29 may include a thickness in a range of about 1 mm to about 13 mm. In some versions, the sealing material 29 may include a thickness in a range of about 0.1 mm to about 13 mm. In some versions, the sealing material 29 may include a thickness in a range of about 0.05 mm to about 13 mm. In addition, the sealing material 29 may be secured to the gypsum liner panels 23, the structural elements 25, 27, or both, at a manufacturing facility prior to assembly of the ASW 21. Alternatively, the sealing material 29 may not be installed at the manufacturing facility; rather, it may be secured to the gypsum liner panels 23, the structural elements 25, 27, or both, during construction and assembly of the ASW 21 itself.

Figure 3:
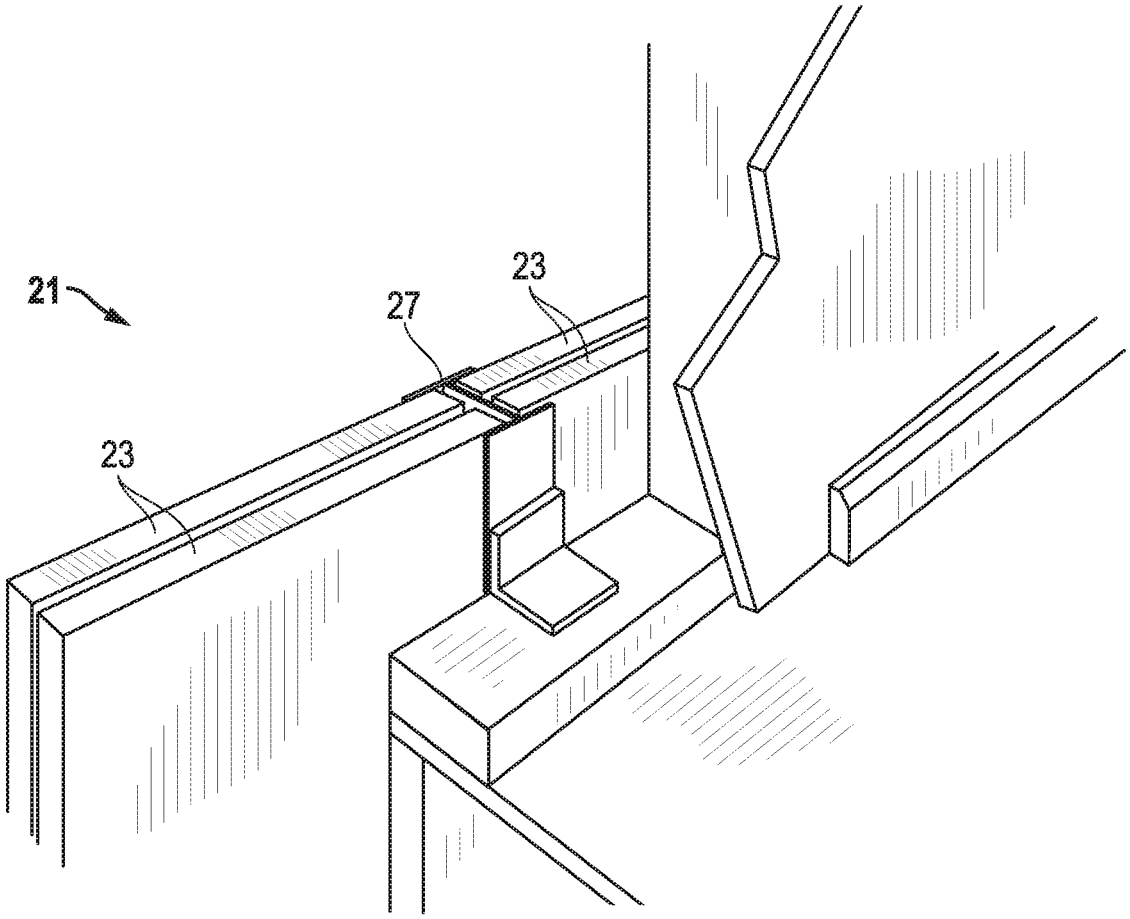
FIG. 3 depicts an embodiment of a sequence of assembly of one version of the ASW.
Figure 4:
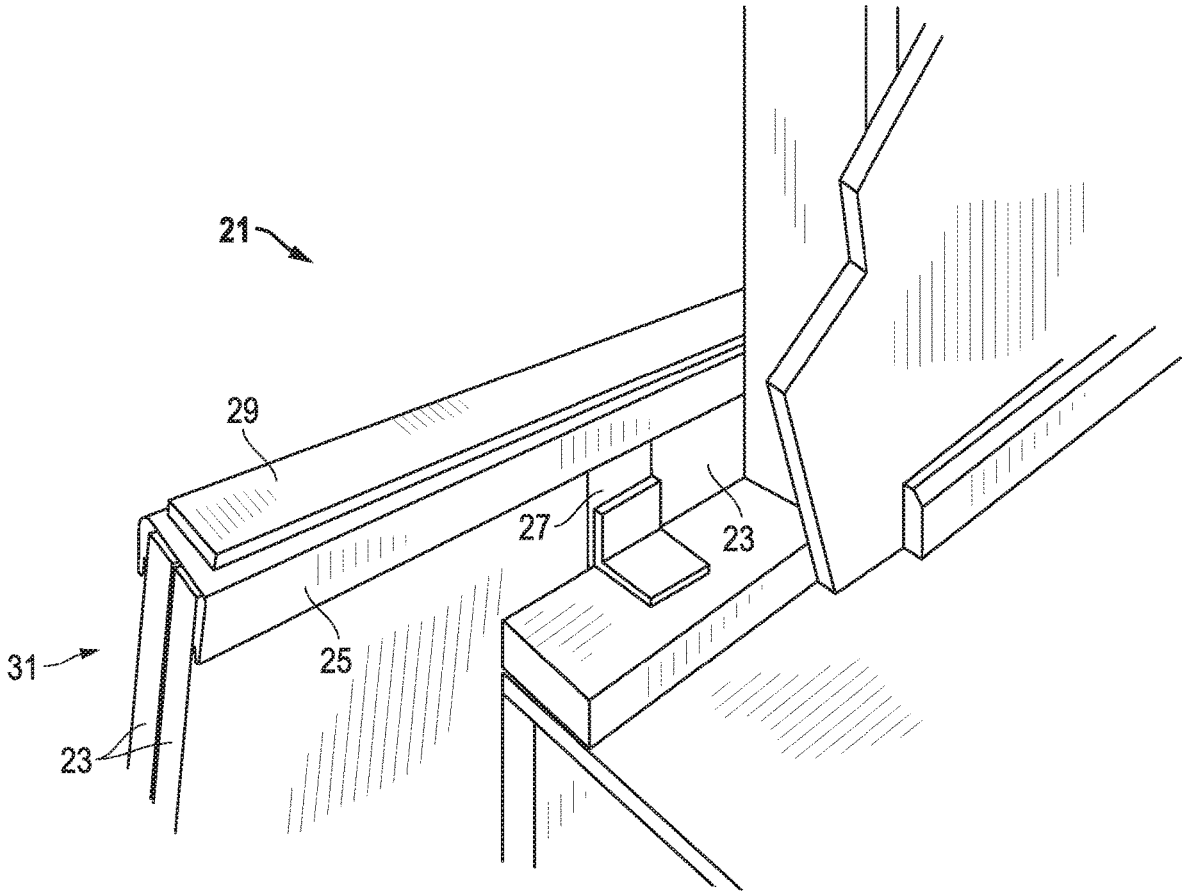
FIG. 4 depicts an embodiment of a sequence of assembly of one version of the ASW.
Figure 5:
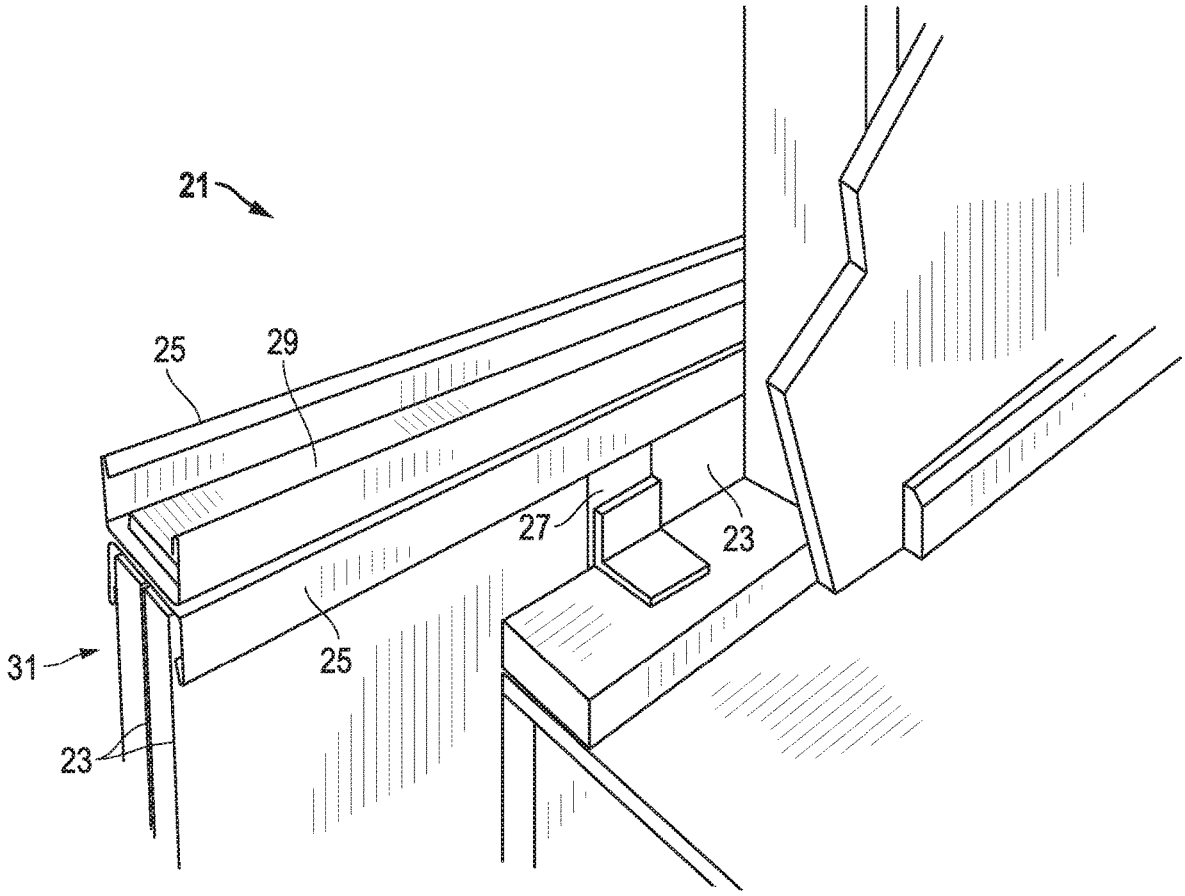
FIG. 5 depicts an embodiment of a sequence of assembly of one version of the ASW.
Figure 6:
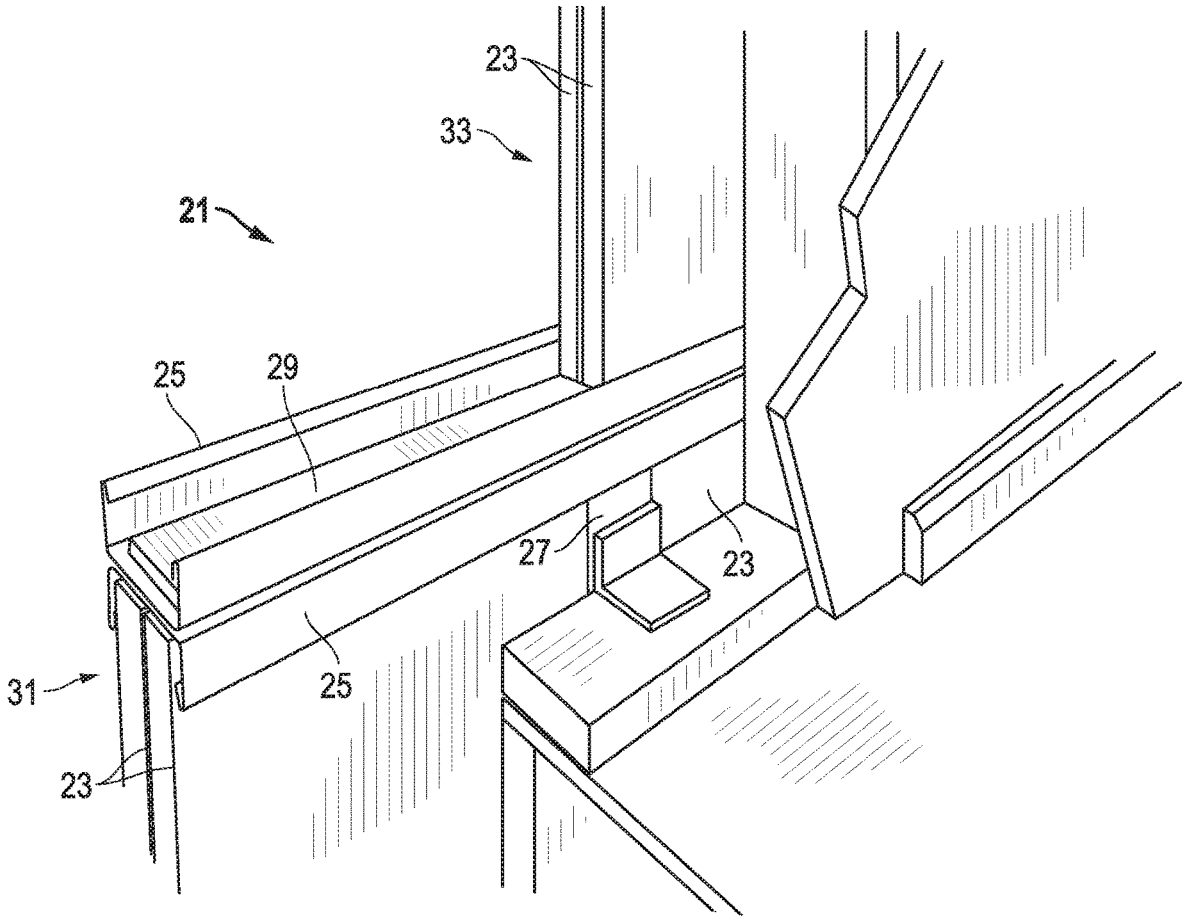
FIG. 6 depicts an embodiment of a sequence of assembly of one version of the ASW.
Figure 7:
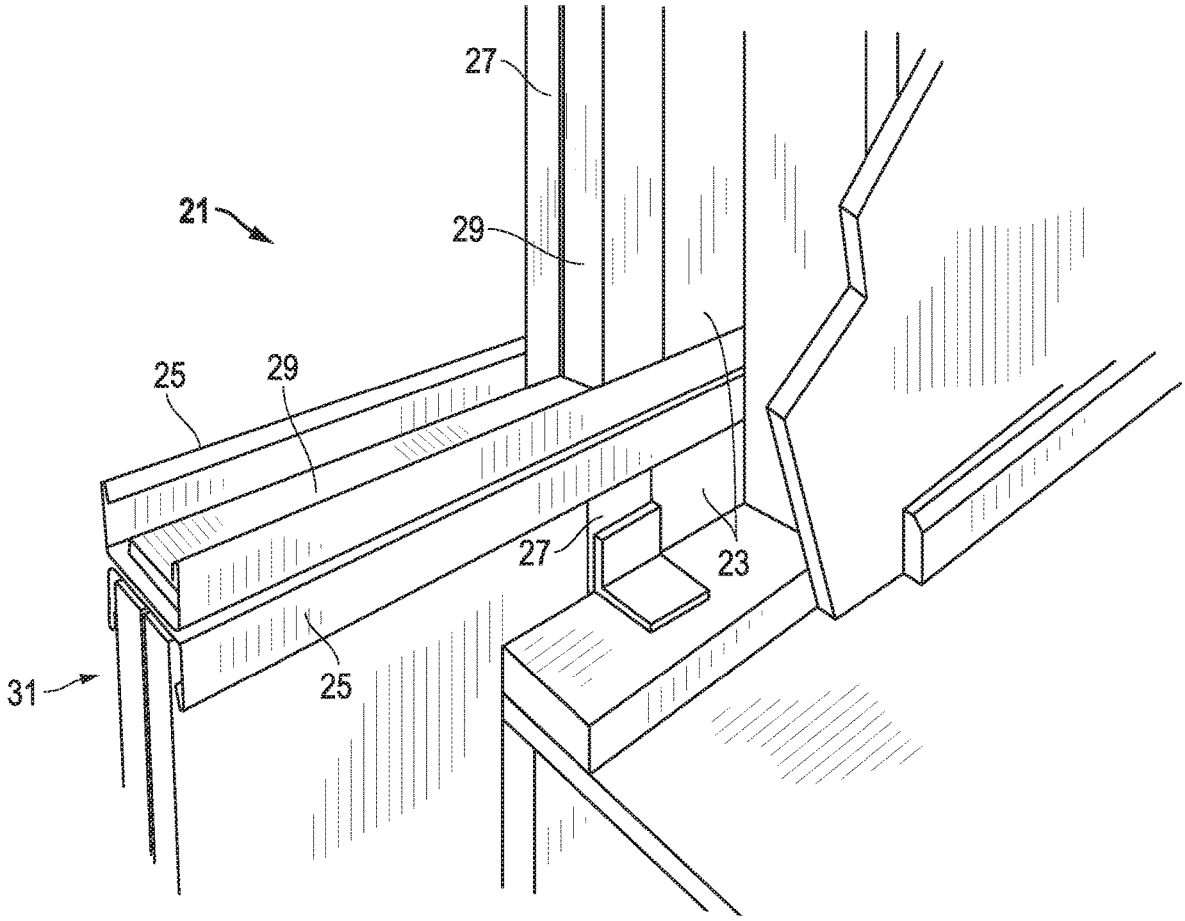
FIG. 7 depicts an embodiment of a sequence of assembly of one version of the ASW.
Figure 8:
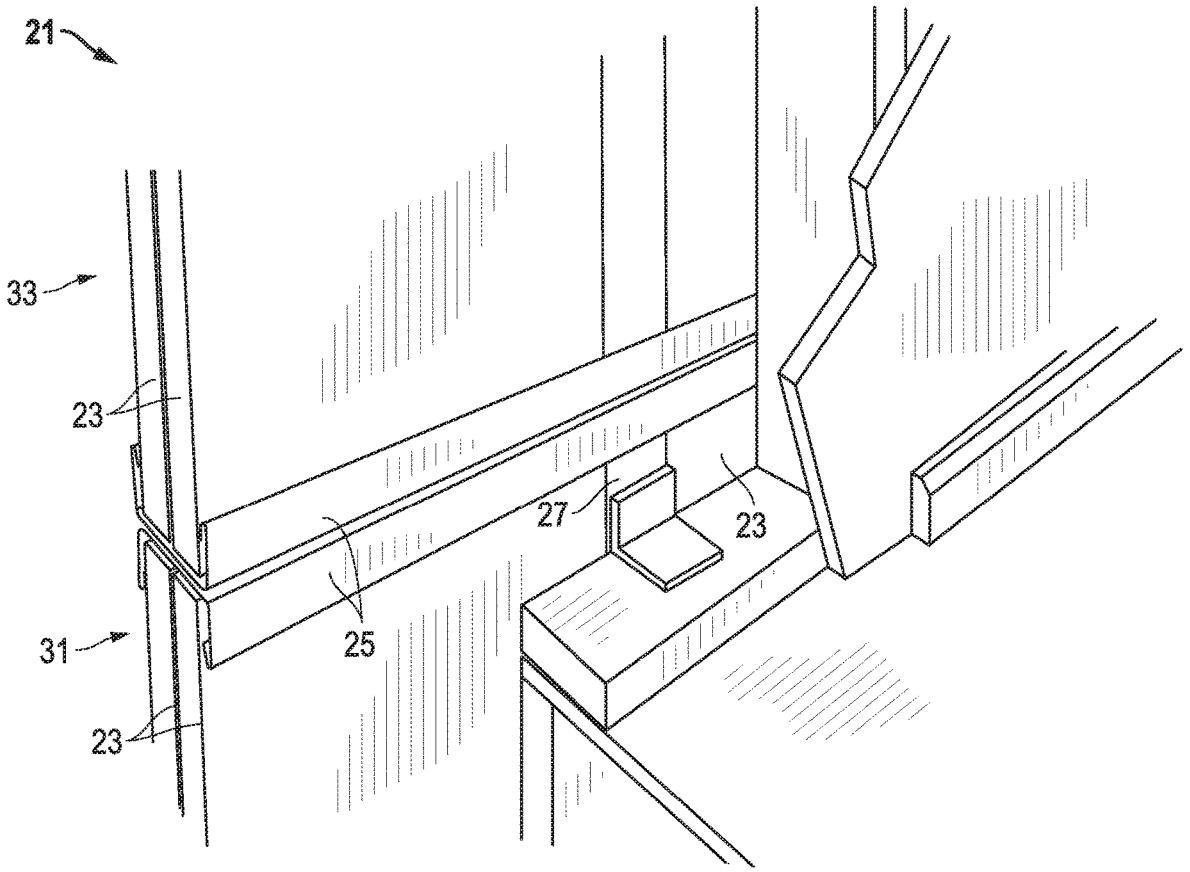
FIG. 8 depicts an embodiment of a sequence of assembly of one version of the ASW.

FIGS. 3-8 depict an embodiment of a sequence of assembly of one version of the ASW 21. For example, FIG. 3 depicts a lower course 31 of the ASW 21, including its gypsum liner panels 23 and structural element 27 (e.g., H-track) therebetween. In FIG. 4, a structural element 25 (e.g., C-track) is placed on top of the lower course 31 along with a sealing material 29. Next (FIG. 5), another but opposing structural element 25 (with its own sealing material 29) is placed on the sealing material 29 on top of the lower course 31. In FIG. 6, an upper course 33 of the ASW 21 is placed into the uppermost structural element 25, and a structural element 27 (FIG. 7) having sealing materials 29 is added to the assembly. Additional gypsum liner panels 23 (FIG. 8) are then added to upper course 33, and seat in both structural elements 25, 27 therebelow and therebehind, respectively.

Figure 9A:
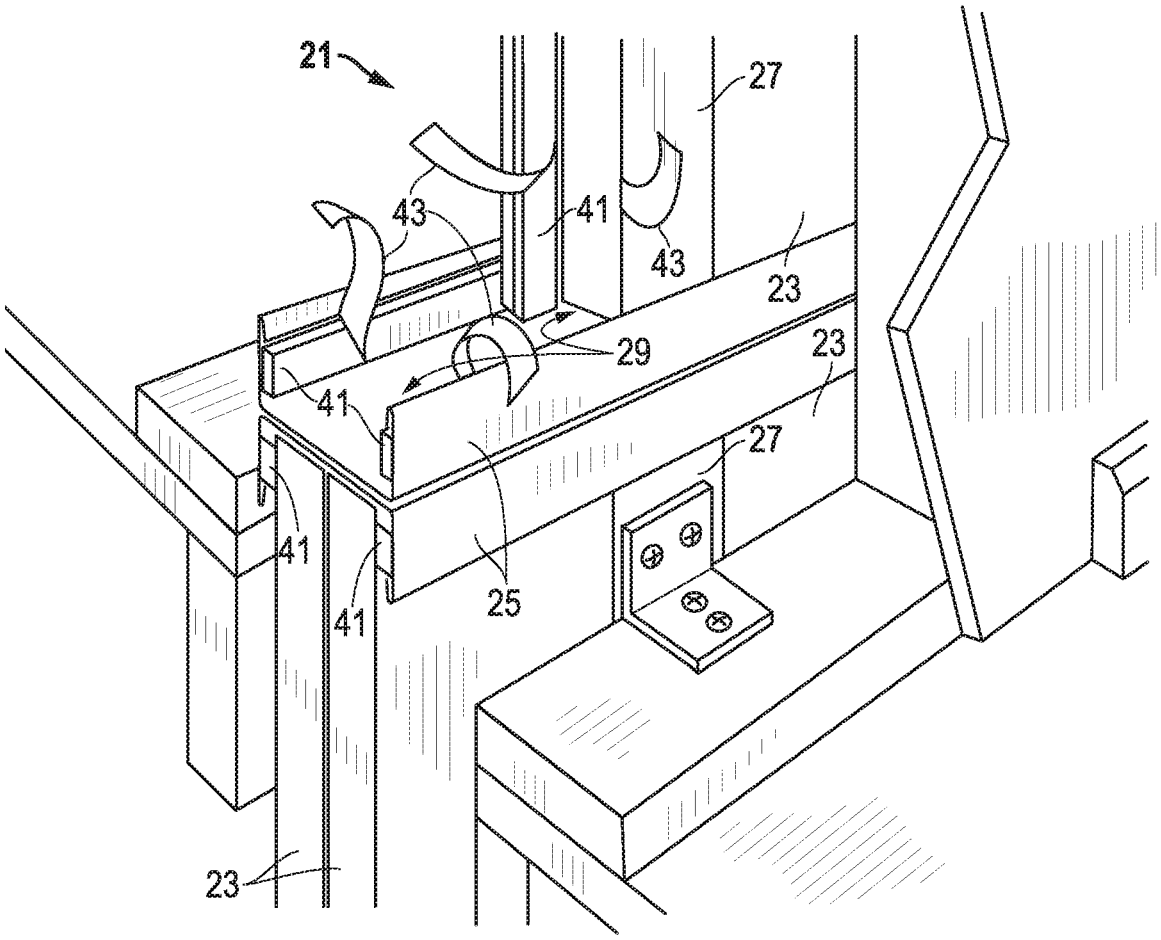
FIG. 9A depicts an isometric view of an embodiment of an ASW with a sealing material.
Figure 9B:
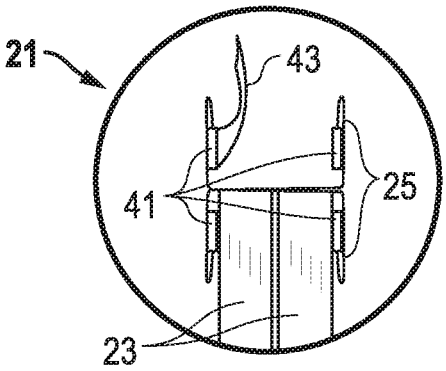
FIG. 9B depicts a side view of an embodiment of an ASW with a sealing material.

As shown in FIGS. 9A and 9B, one embodiment of the sealing material 29 may include two-sided adhesive foam strips 41 with a first side adhered to either the gypsum liner panels 23 or the structural elements 25, 27, and a second side adhered to the other of the gypsum liner panels 23 and the structural elements 25, 27. In one version, the second sides of the two-sided adhesive foam strips 41 may be configured to comprise removable liners 43 that are removed prior to assembly of the ASW 21.

Figure 10A:
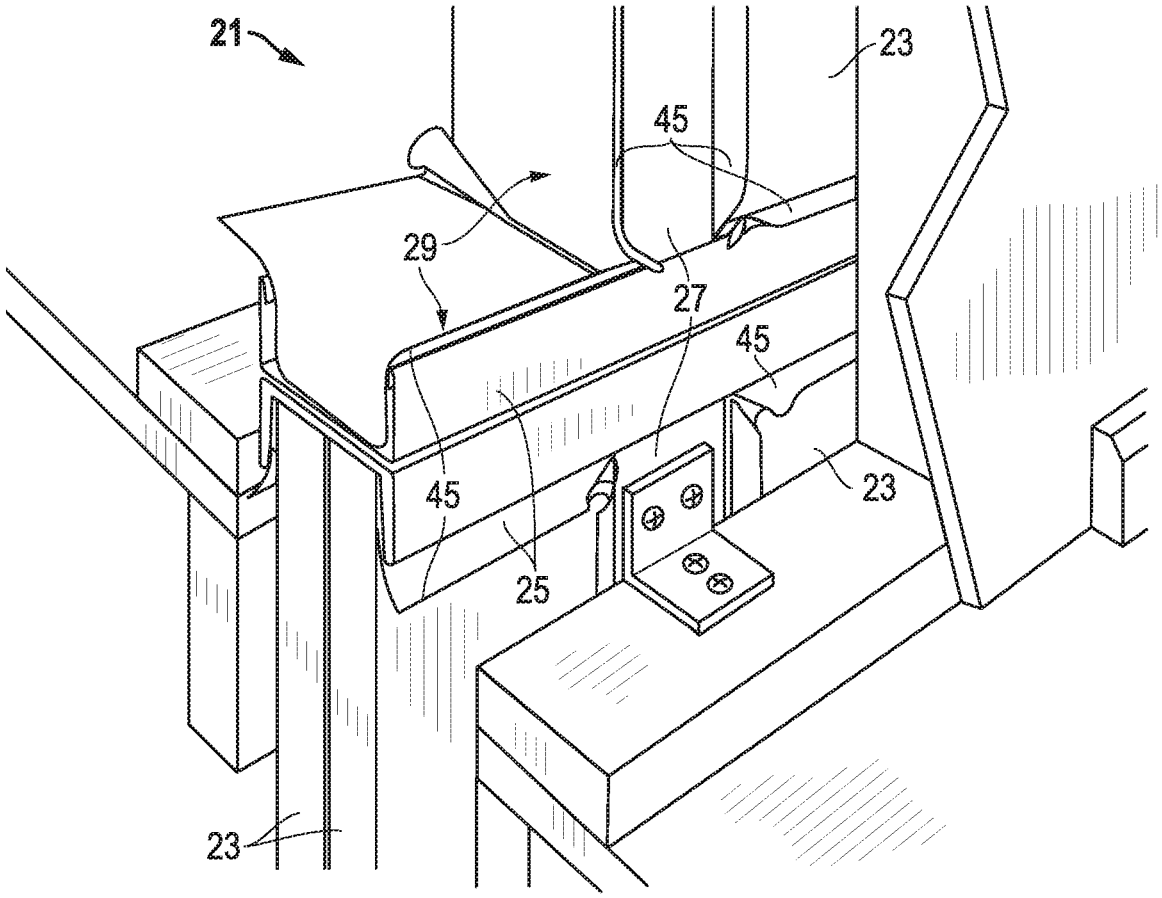
FIG. 10A depicts an isometric view of an embodiment of an ASW with a sealing material.
Figure 10B:
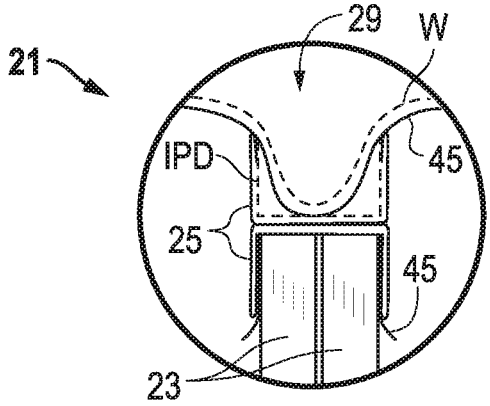
FIG. 10B depicts a side view of an embodiment of an ASW with a sealing material.

FIGS. 10A and 10B illustrate that the structural elements 25, 27 have an interior perimeter dimension (IPD). The sealing material 29 may include sheets 45 that are flexible and have a width W that exceeds the interior perimeter dimension IPD of the structural elements 25, 27. In one version, the sheets 45 may be applied during assembly of the ASW 21.

Figure 11A:
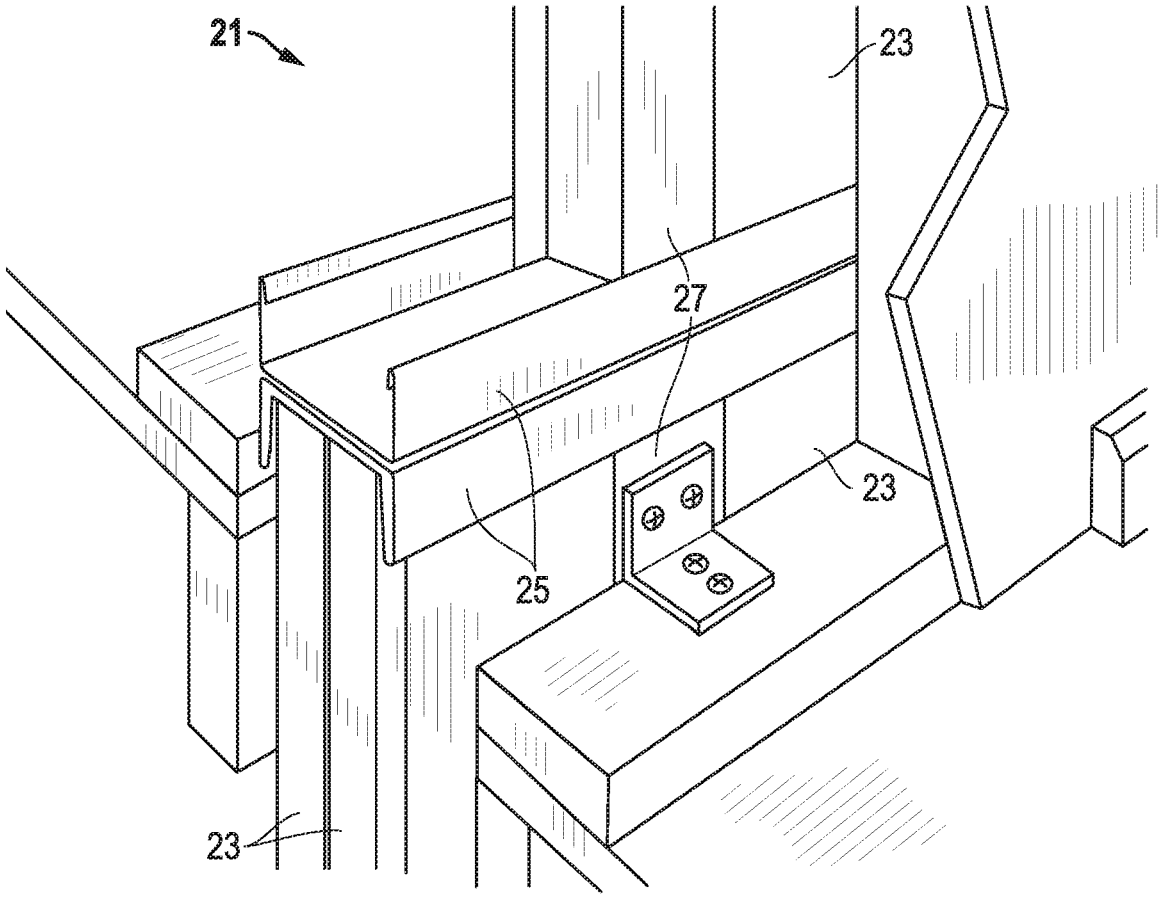
FIG. 11A depicts an isometric view of an embodiment of an ASW with a sealing material.
Figure 11B:
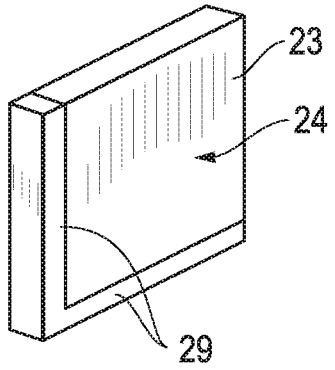
FIG. 11B depicts a perspective view of an embodiment of an ASW with a sealing material.
Figure 17A:
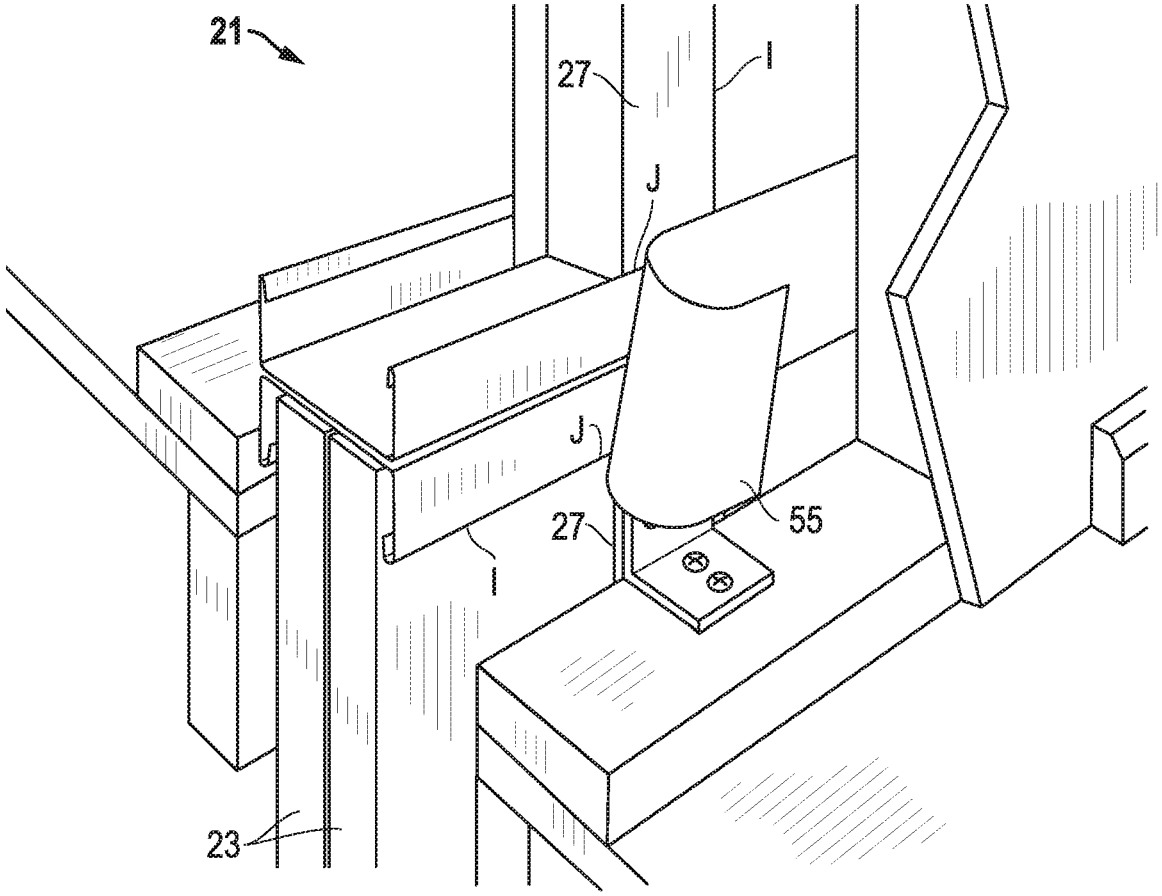
FIG. 17A depicts an isometric view of an embodiment of an ASW with a sealing material.
Figure 17B:
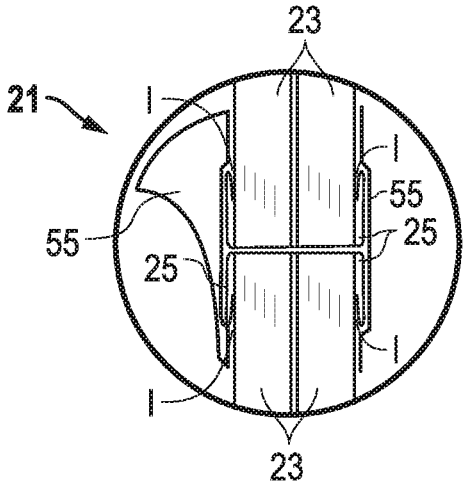
FIG. 17B depicts a side view of an embodiment of an ASW with a sealing material.
Figure 17C:
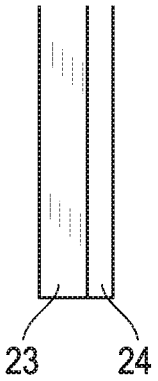
FIG. 17C depicts a side view of an embodiment of an ASW.

Referring to FIGS. 11A and 11B, in one embodiment the sealing material 29 may be secured only to the gypsum liner panels 23, rather than to the structural elements 25, 27. For example, the sealing material 29 may be located only adjacent perimeter edges of the gypsum liner panels 23. In another version, the gypsum liner panels 23 may include a surface treatment 24 (FIGS. 11B and 17C) comprising a film, coating, laminate or primer, or any combination thereof. The surface treatment 24 may be configured to provide improved adherence thereto by the sealing material 29. The surface treatment 24 may be applied during manufacturing of the gypsum liner panels 23, or as a primer in the field during assembly of the ASW 21.

Figure 12A:
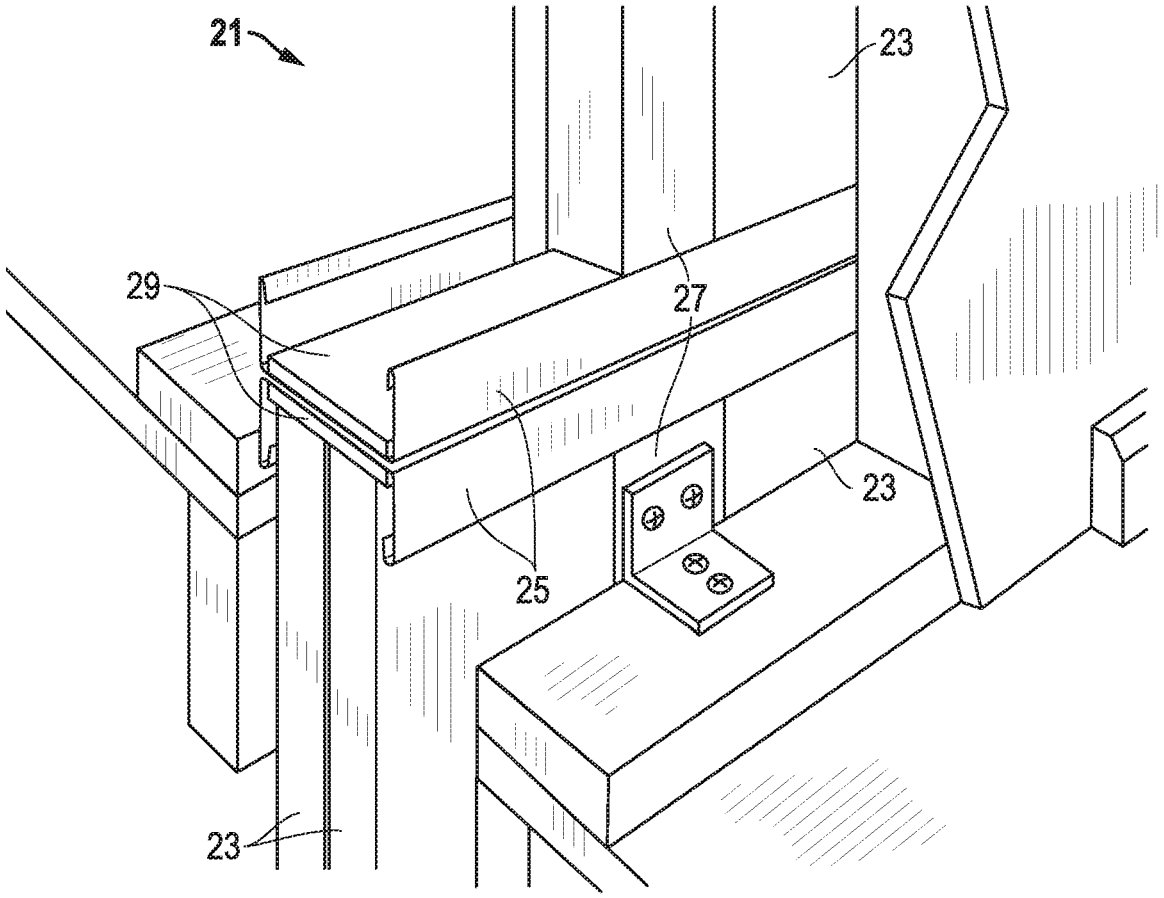
FIG. 12A depicts an isometric view of an embodiment of an ASW with a sealing material.
Figure 12B:
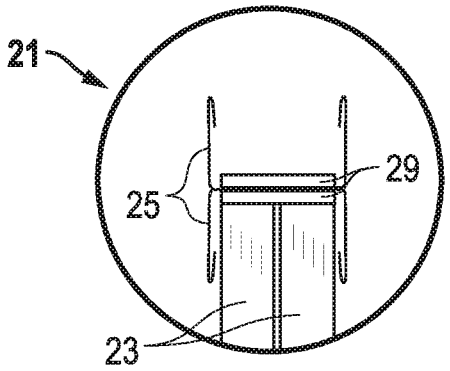
FIG. 12B depicts a side view of an embodiment of an ASW with a sealing material.
Figure 13A:
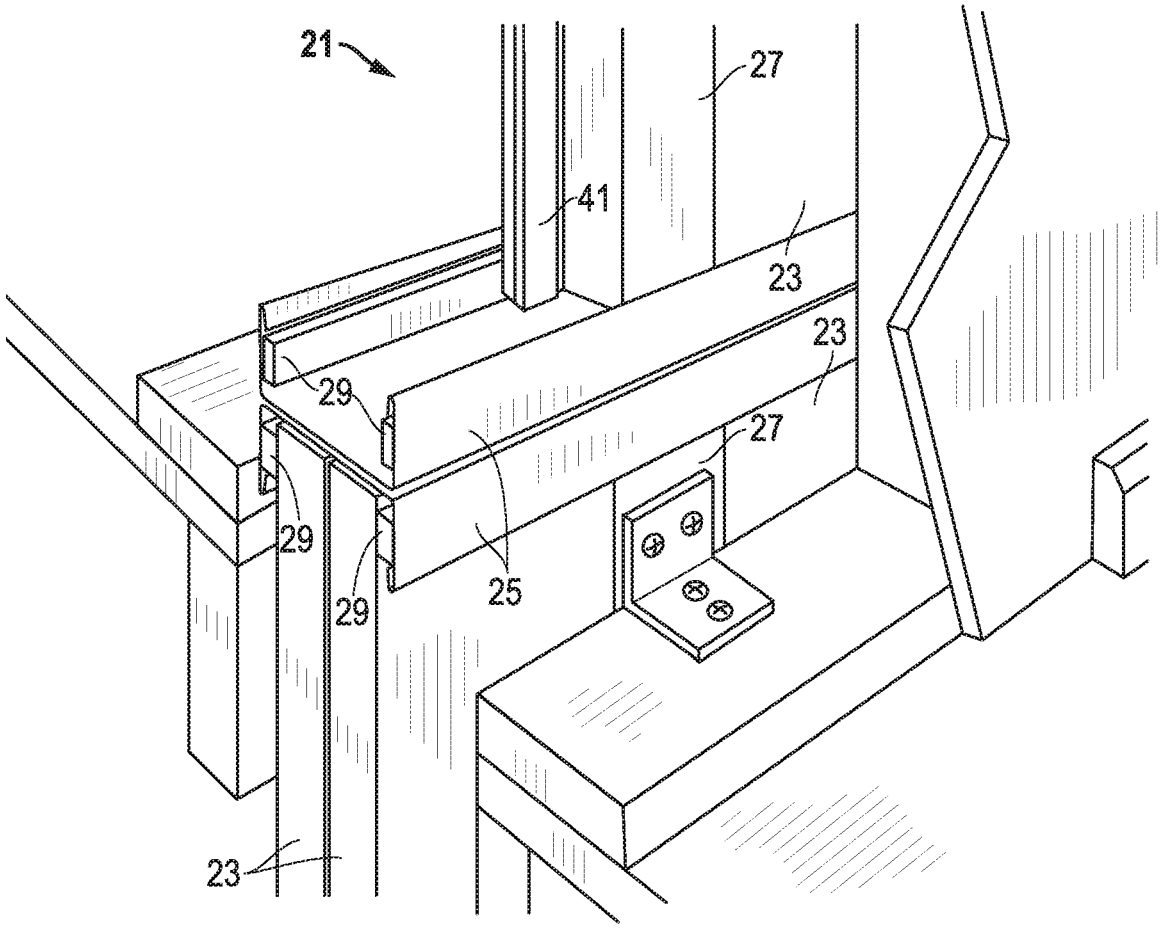
FIG. 13A depicts an isometric view of an embodiment of an ASW with a sealing material.
Figure 13B:
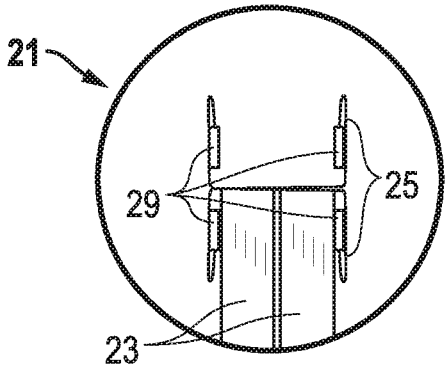
FIG. 13B depicts a side view of an embodiment of an ASW with a sealing material.
Figure 14A:
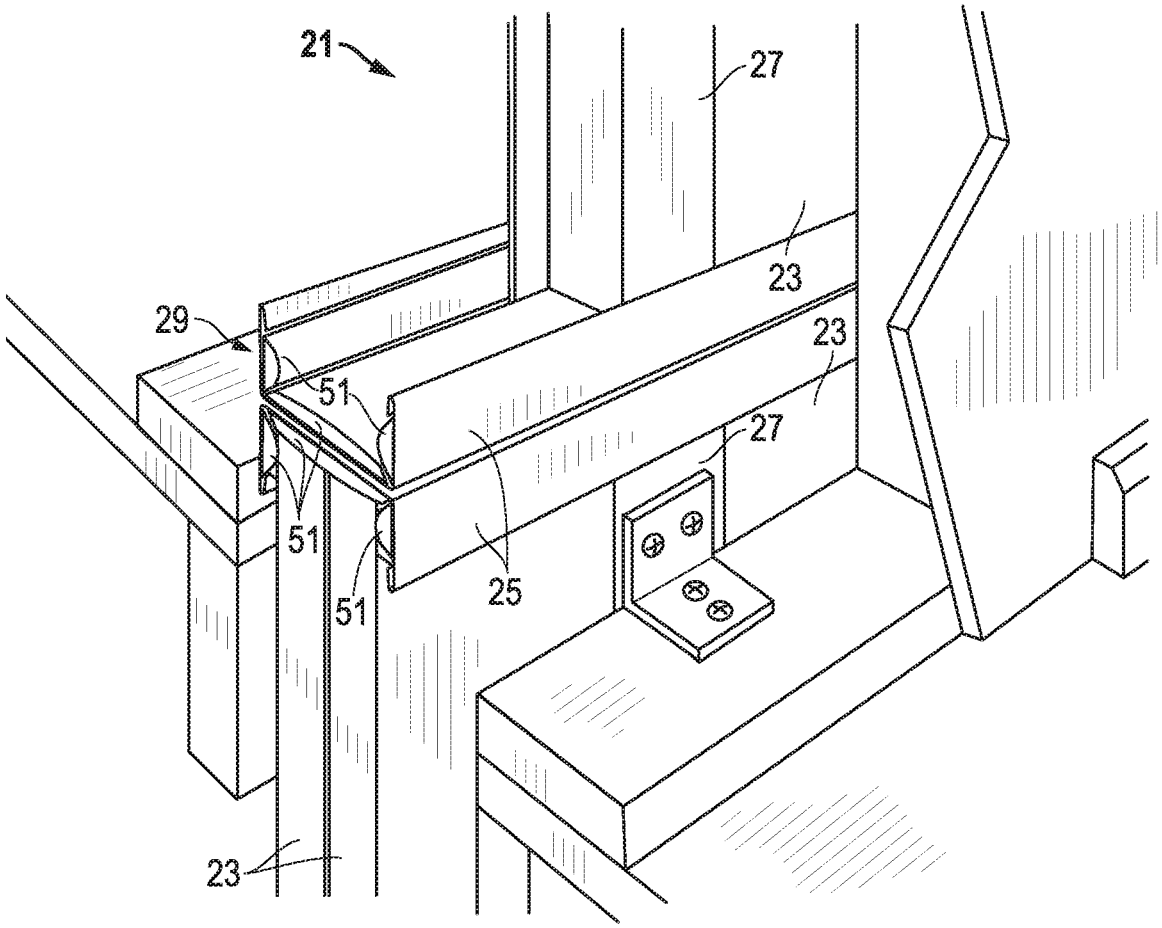
FIG. 14A depicts an isometric view of an embodiment of an ASW with a sealing material.
Figure 14B:
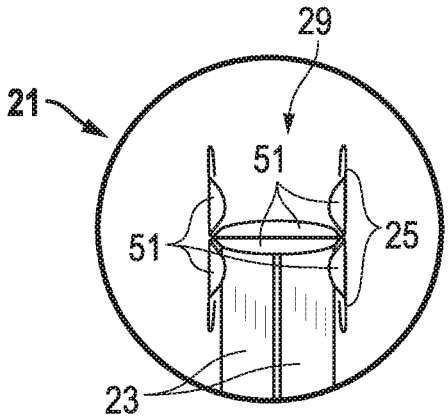
FIG. 14B depicts a side view of an embodiment of an ASW with a sealing material.
Figure 15A:
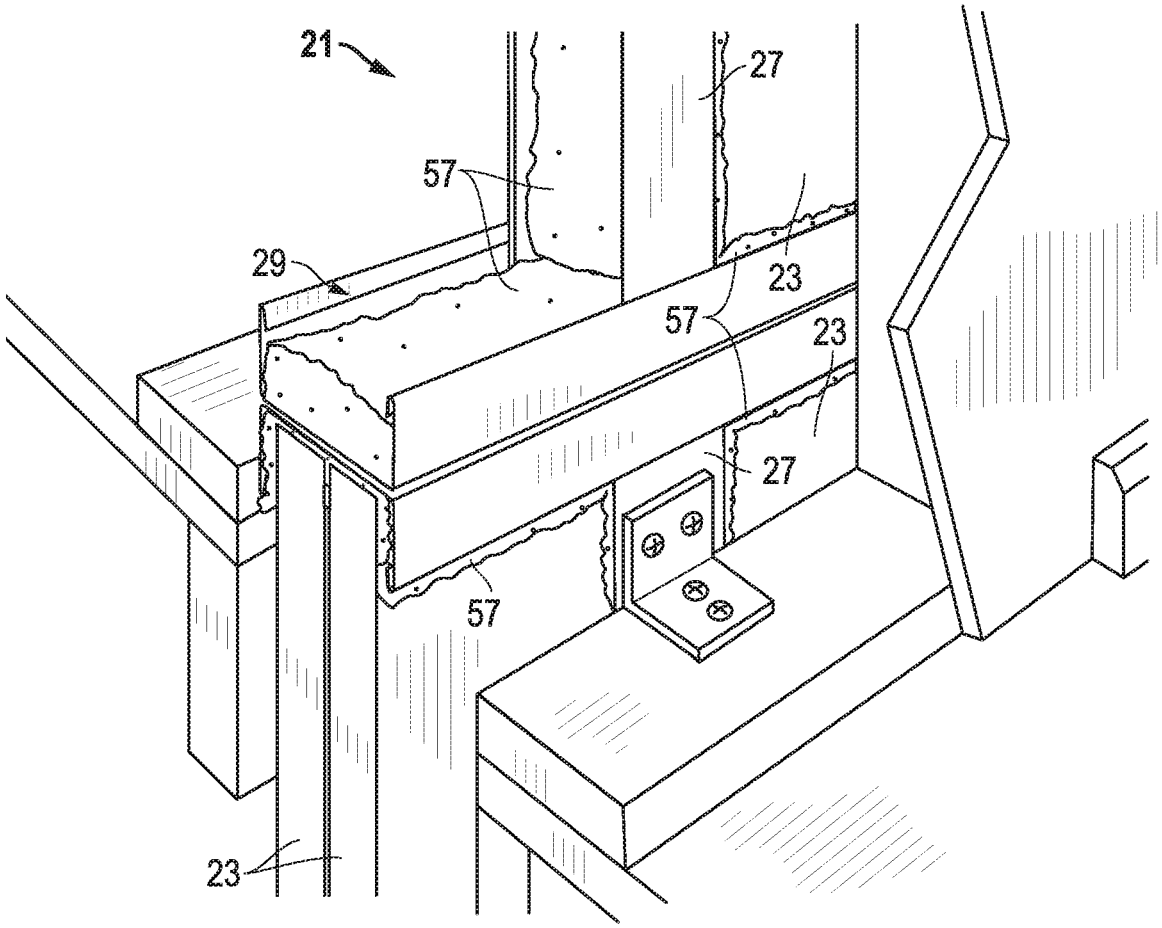
FIG. 15A depicts an isometric view of an embodiment of an ASW with a sealing material.
Figure 15B:
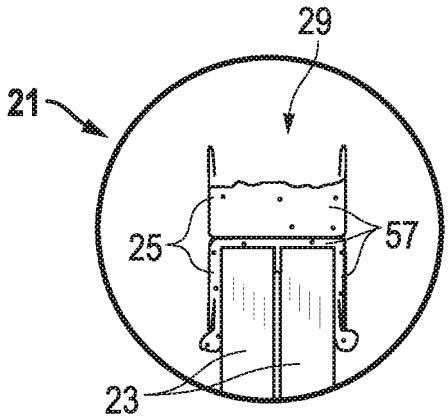
FIG. 15B depicts a side view of an embodiment of an ASW with a sealing material.
Figure 16A:
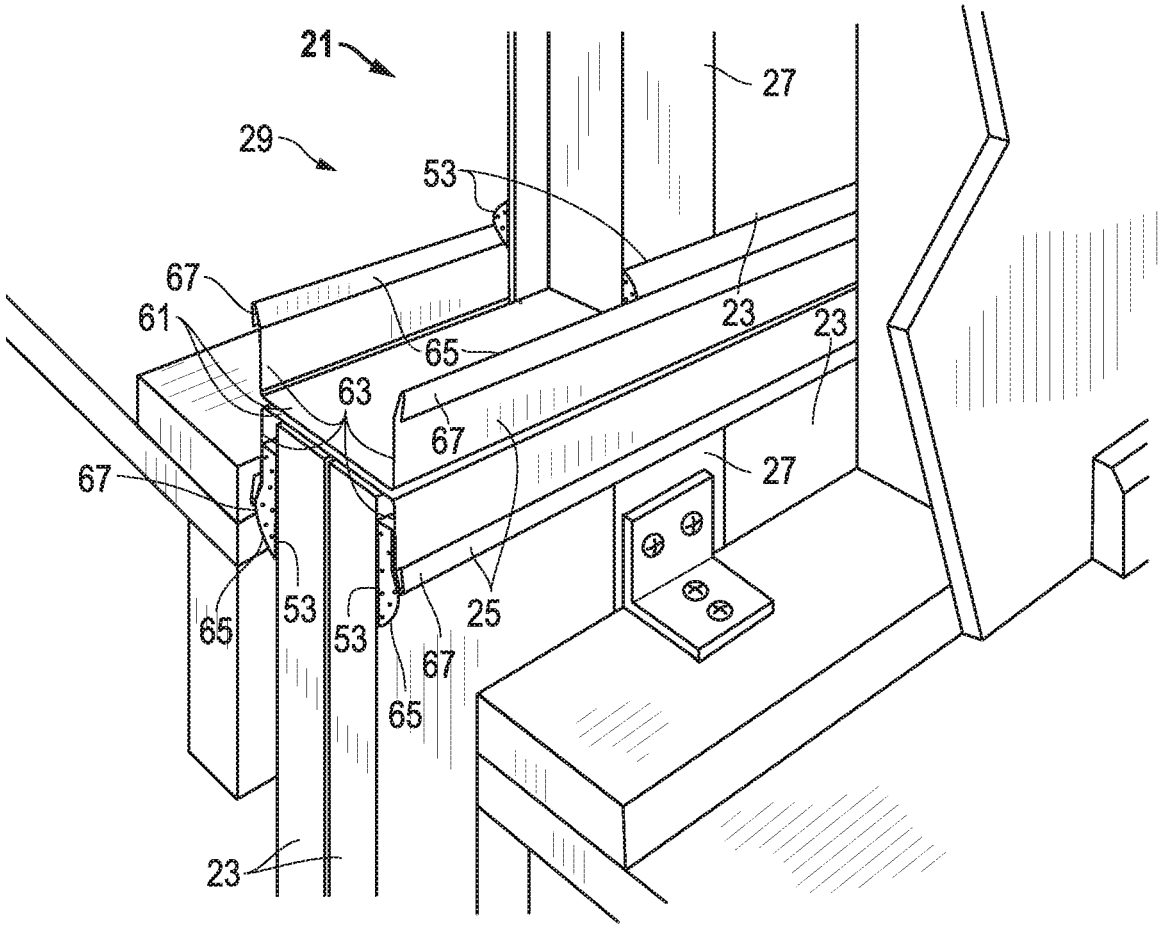
FIG. 16A depicts an isometric view of an embodiment of an ASW with a sealing material.
Figure 16B:
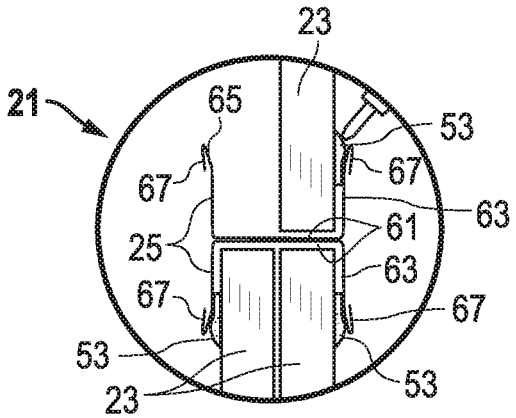
FIG. 16B depicts a side view of an embodiment of an ASW with a sealing material.

In some versions, the sealing material 29 may be secured only to the structural elements 25, 27. For example, in the ASW 21, the sealing material 29 may be oriented horizontally (FIG. 12), vertically (FIG. 13) or both (FIGS. 14-15). The sealing material 29 may be oriented only horizontally, or only vertically. In other embodiments, the sealing material 29 may include profile-extruded foam gaskets 51 (FIGS. 14A-14B). Some embodiments of the sealing material 29 may include one or more of the following components: a sealant (e.g., acoustical sealant), caulk 53 (FIG. 16; e.g., latex caulk), tape 55 (FIG. 17), gasket, foam 57 (FIGS. 15A-15B; e.g., spray-applied foam sealant, such as low-expanding foam sealant), coating (e.g., spray or roll-applied, or such as surface treatment 24) water activated adhesive and mastic.

Figure 18:
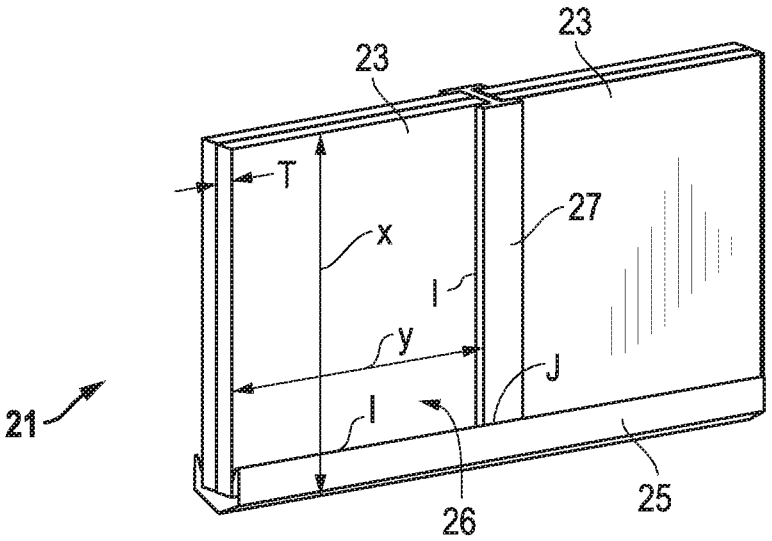
FIG. 18 depicts a schematic isometric view of yet another embodiment of the ASW.

Embodiments of the ASW 21 may include gypsum liner panels 23 each having a facing surface 26 (FIG. 18) having a major axis X along a length of the gypsum liner panel 21, a minor axis Y that is perpendicular to the major axis X along a width of the gypsum liner panel 21, and a thickness T that is transverse to the length and width. Interfaces I may be defined between the facing surfaces 26 of the gypsum liner panels 21 and the structural elements 25, 27. Joints J may be defined between adjacent ones of the structural elements 25, 27. In addition, the ASW 21 may further include tape 55 (FIG. 17) applied over the interfaces I, the joints J or both, to seal or further seal the ASW 21.

Again referring to FIG. 16, at least some of the structural elements 25, 27 may include a track having a base 61 and flanges 63 extending from the base 61. Each flange 63 may include a lip 65 that protrudes away and outward therefrom. Each lip 65 may further include a folded portion 67 that is folded adjacent an exterior of the lip 65.

When the gypsum liner panels 21 are installed in the structural elements 25, 27, the lip 65 may provide a rut between the structural elements 25, 27 and the gypsum liner panels 21. A second sealing material (e.g., caulk 53) may be located in the ruts between the structural elements 25, 27 and the gypsum liner panels 21. The second sealing material could be same as the sealing material 29, or a different material.

In other examples, the sealing material 29 may be located on the interiors of the structural elements 25, 27, on the exteriors of the structural elements 25, 27, or on both.

Figure 19A:
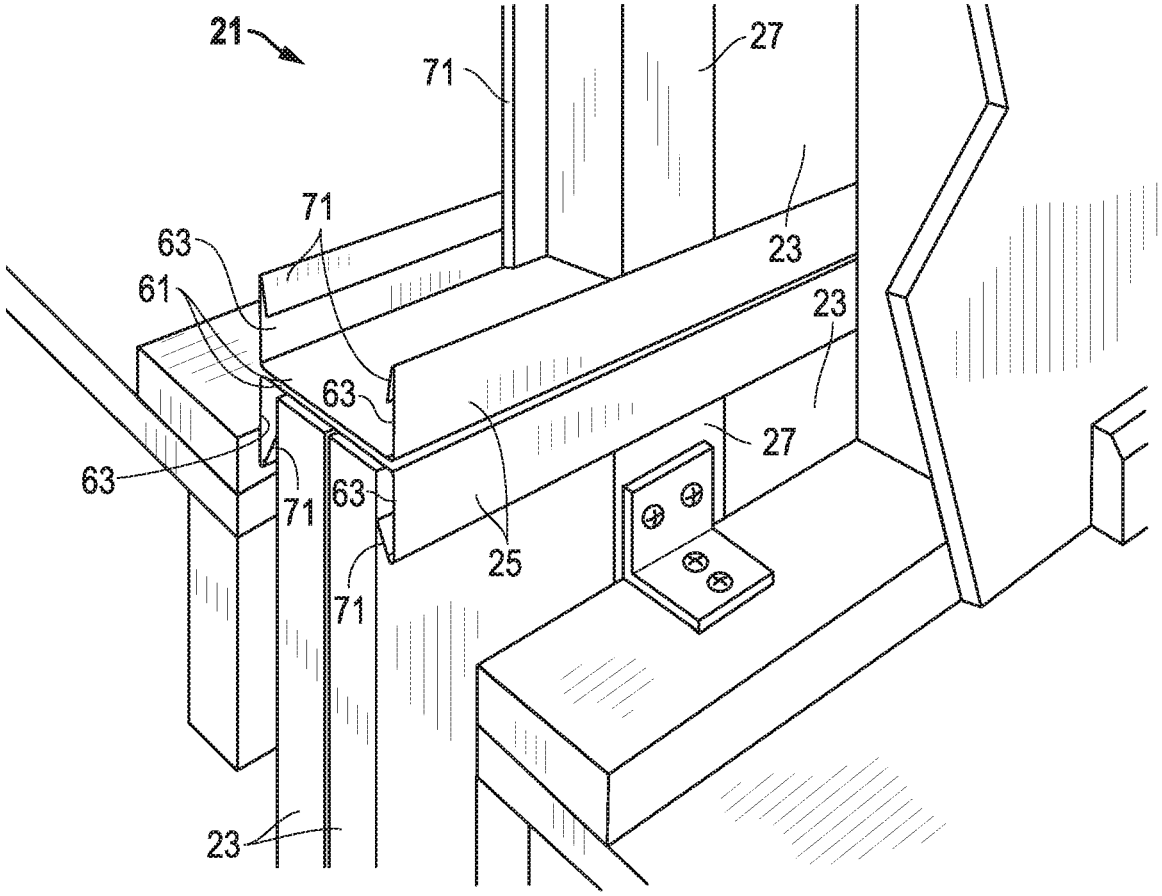
FIG. 19A depicts an isometric view of an embodiment of an ASW.
Figure 19B:
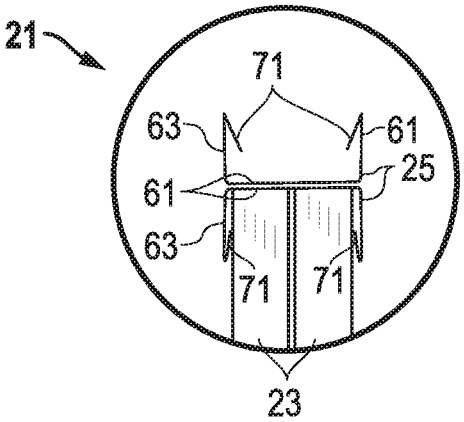
FIG. 19B depicts a side view of an embodiment of an ASW.

FIG. 19 discloses that at least some of the structural elements 25, 27 may include a spring stud track. The spring stud track may include a generally C-shaped sectional profile including a base 61 and flanges 63 extending from the base. Each flange 63 may include a lip 71 that protrudes inward therefrom and toward the base 61. When the gypsum liner panels 21 are installed in the spring stud track, the lips 71 provide a spring force bias against the gypsum liner panels 21 to seal or further seal the ASW 21.

Figure 20A:
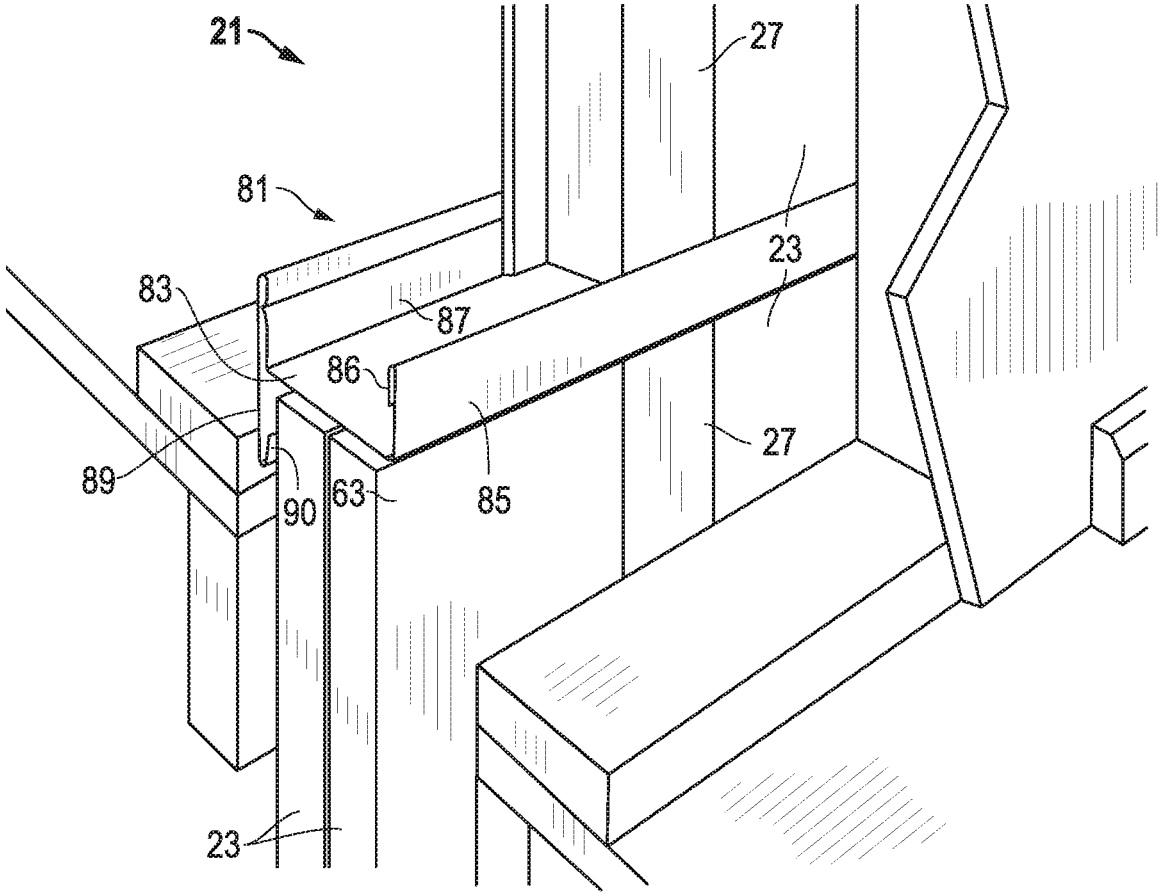
FIG. 20A depicts an isometric view of an embodiment of an ASW.
Figure 20B:
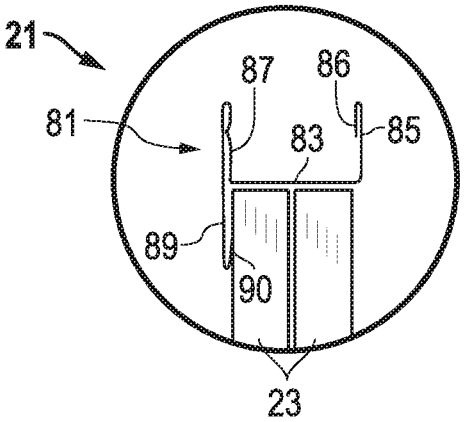
FIG. 20B depicts a side view of an embodiment of an ASW.
Figure 21A:
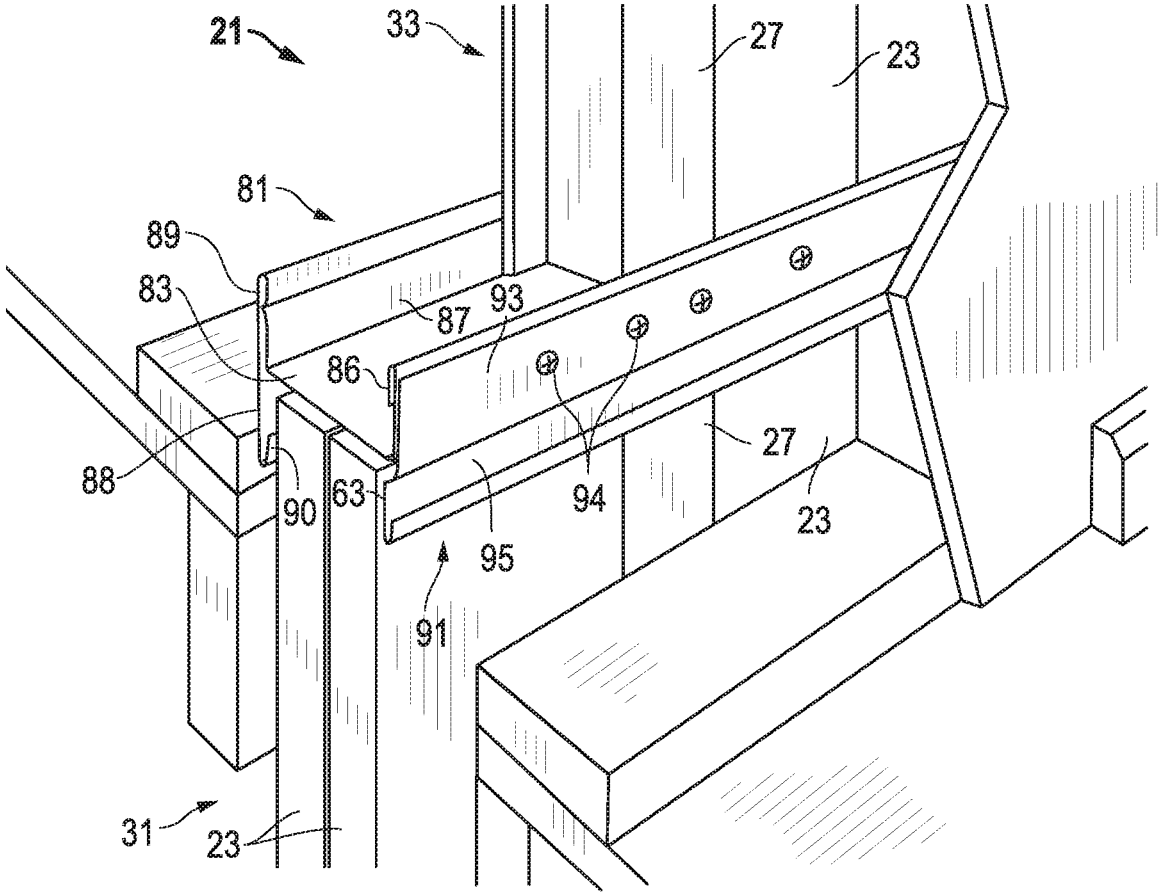
FIG. 21A depicts an isometric view of an embodiment of an ASW.
Figure 21B:
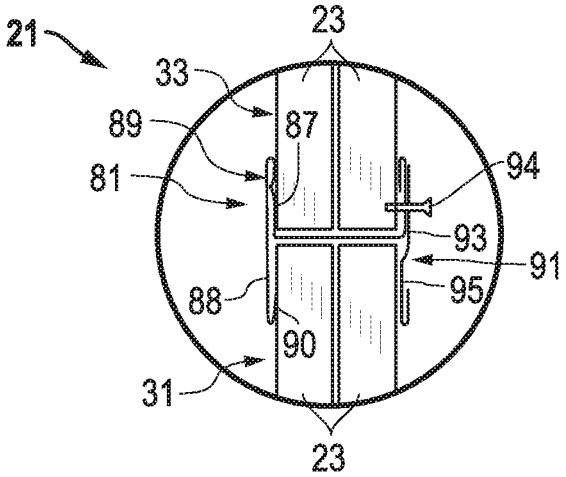
FIG. 21B depicts a side view of an embodiment of an ASW.

The ASW 21 may include alternate embodiments of the structural elements. For example, FIG. 20 illustrates a one-sided track 81 having a base 83 with only three walls. First and second walls 85, 87 extend in a same direction, and a third wall 89 extends opposite to the first and second walls 85, 87. In addition, a place or face piece 91 (FIG. 21) may be secured to the ASW 21 adjacent the one-sided track 81 to form a fourth wall across from the third wall 89.

At least some of the structural elements may include the one-sided track 81, which may include a generally J-shaped sectional profile including the base 83. A first side may include the first wall 85 extending from the base 83. The first wall may include a first lip 86 folded adjacent an interior of the first wall 85 toward the base 83. A second side may include the second wall 87 extending from the base 83. The second wall 87 may include a second lip 88 folded adjacent an exterior of the second wall 87. The second lip 88 may extend beyond the base 83 for approximately a same distance as the second wall 87 extends from the base 83. The second lip 88 may include a third lip 90 folded adjacent an interior of the second lip 88. The first wall 85, first lip 86, second wall 87, second lip 88 and third lip 90 may be substantially parallel to each other.

In one version, the upper course 33 of the gypsum liner panels 21 may be installed on the base 83 between the first and second walls 85, 87 such that they are captured between the first and second sides. The lower course 31 of the gypsum liner panels 21 may be installed on the base 83 opposite the first and second walls 85, 87, such that they are captured only by the second and third lips 88, 90 on the second side of the one-sided track 81, but are exposed on the first side of the one-sided track 81 across from the second and third lips 88, 90.

The ASW 21 may further include the plate or face piece 91 having a proximal segment 93 that may be secured, such as with fasteners 94, to the first wall 85 of the one-sided track 81. The face piece 91 may include a distal segment 95 that extends from the proximal segment 93 beyond the base 83, generally parallel to the second lip 88, to capture the exposed side of the lower course 31 of gypsum liner panels 21. The distal segment 95 may be generally parallel to and aligned with the first wall 85.

In some versions, the ASW 21 may further include a sound transmission class (STC), such as those specified in ASTM E90. For example, the ASW 21 may be assembled adjacent to one conventional interior finish wall or between two conventional adjacent interior finish walls to form a construction. Embodiments of the construction may include an STC (per ASTM E90) of at least about 55, at least about 56, at least about 57, at least about 58, at least about 59, at least about 60, at least about 61, at least about 62, at least about 63, at least about 64, or even at least about 65. The STC may be in a range between any of these values.

Embodiments of a method of constructing an ASW includes a gypsum material, steel frame and air seal that achieves at least a 2-hour fire resistance rating using ANSI/

UL 263, and satisfies air leakage requirements using ASTM E2357 and ASTM E283, after the ASW 21 is assembled, based on the laboratory test.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An area separation wall (ASW), comprising:

a plurality of gypsum liner panels;

a plurality of horizontal structural elements configured to receive adjacent gypsum liner panels within an elongated track having a base and flanges extending from the base; and a first sealing material consisting of a flexible flashing tape, a compressed gasket pressure sensitive foam tape, a two-sided adhesive foam tape, or a water activated adhesive adhered to an interior of each of the flanges of the elongated tracks of the horizontal structural elements, such that only the first sealing material is disposed between the gypsum liner panels and the flanges of the elongated tracks of the horizontal structural elements when the adjacent gypsum liner panels are inserted into the elongated tracks of the horizontal structural elements to provide a substantially airtight seal between the gypsum liner panels and the horizontal structural elements, wherein the ASW comprises the adjacent gypsum liner panels inserted into the elongated tracks of the horizontal structural elements, and wherein the ASW comprises:

a fire rating of at least 2 hours in compliance with ANSI/UL 263; and an air permeance of not greater than 0.44 cfm/ft$^2$ under a pressure differential of 0.3 in water (1.57 psf) (2.25 L/s·m$^2$ @ 75 Pa).

2. The ASW of claim 1, wherein the air permeance is not greater than 0.38 cfm/ft$^2$, under a pressure differential of 0.3 in water (1.57 psf), when tested with the method prescribed by ASTM E2357.

3. The ASW of claim 1, wherein the first sealing material comprises an air permeance of not greater than 0.004 cfm/ft$^2$ under a pressure differential of 0.3 in water (1.57 psf) (0.02 L/s·m$^2$ @ 75 Pa) when tested with the method prescribed by ASTM E2178.

4. The ASW of claim 1, wherein the horizontal structural elements comprise a generally C-shaped sectional profile, and wherein the first sealing material is disposed between adjacent horizontal structural elements.

5. The ASW of claim 4, wherein the first sealing material is adhered between an exterior of the bases of adjacent horizontal structural elements.

6. The ASW of claim 1, further comprising: at least one vertical structural element configured to receive the adjacent gypsum liner panels within an elongated track having a base and flanges extending from the base.

7. The ASW of claim 6, wherein the at least one vertical structural element is disposed within at least one of the horizontal structural elements.

8. The ASW of claim 7, wherein the first sealing material is adhered to the interior of flanges of the elongated track of the at least one vertical structural element.

9. The ASW of claim 8, wherein the first sealing material is disposed between the gypsum liner panels and each of the flanges of the elongated track of the at least one vertical structural element.

10. The ASW of claim 9, wherein the horizontal structural elements comprise a generally C-shaped sectional profile, and wherein the at least one vertical structural element comprises a generally-H-shaped sectional profile.

11. An area separation wall (ASW), comprising:

a plurality of gypsum liner panels;

a plurality of horizontal structural elements configured to receive adjacent gypsum liner panels within an elongated track having a base and flanges extending from the base; and a first sealing material consisting of a flexible flashing tape, a compressed gasket pressure sensitive foam tape, a two-sided adhesive foam tape, or a water activated adhesive adhered to a face of each of the gypsum liner panels, such that only the first sealing material is disposed between the gypsum liner panels and the flanges of the elongated tracks of the horizontal structural elements when the adjacent gypsum liner panels are inserted into the elongated tracks of the horizontal structural elements to provide a substantially airtight seal between the gypsum liner panels and the horizontal structural elements, wherein the ASW comprises the adjacent gypsum liner panels inserted into the elongated tracks of the horizontal structural elements, and wherein the ASW comprises:

a fire rating of at least 2 hours in compliance with ANSI/UL 263; and an air permeance of not greater than 0.44 cfm/ft$^2$ under a pressure differential of 0.3 in water (1.57 psf) (2.25 L/s·m$^2$ @ 75 Pa).

12. The ASW of claim 11, further comprising: at least one vertical structural element configured to receive the adjacent gypsum liner panels within an elongated track having a base and flanges extending from the base.

13. The ASW of claim 11, wherein the first sealing material is disposed between the one or more faces of the gypsum liner panels and each of the flanges of the elongated track of the at least one vertical structural element.

14. A method of forming an area separation wall (ASW), comprising:

providing a plurality of gypsum liner panels and a plurality of horizontal structural elements configured to receive adjacent gypsum liner panels within an elongated track having a base and flanges extending from the base;

applying a first sealing material consisting of a flexible flashing tape, a compressed gasket pressure sensitive foam tape, a two-sided adhesive foam tape, or a water activated adhesive, to at least one of (1) an interior of each of the flanges of the elongated track of the horizontal structural elements and (2) a face of each of the plurality of gypsum liner panels; and after applying the first sealing material, inserting adjacent gypsum liner panels into the elongated track of at least one of the plurality of horizontal structural elements, such that only the first sealing material is disposed between the gypsum liner panels and the flanges of the elongated track of the at least one of the plurality of horizontal structural elements when the adjacent gypsum liner panels are inserted into the elongated track of the at least one of the plurality of horizontal structural elements to provide a substantially airtight seal between the gypsum liner panels and the at least one of the plurality of horizontal structural elements.

15. The method of claim 14, wherein the ASW, upon inserting the adjacent gypsum liner panels into the elongated track of the at least one of the plurality of horizontal structural elements, comprises:

a fire rating of at least 2 hours in compliance with ANSI/UL 263; and an air permeance of not greater than 0.44 cfm/ft$^2$ under a pressure differential of 0.3 in water (1.57 psf) (2.25 L/s·m$^2$ @ 75 Pa).

16. The method of claim 14, further comprising: inserting the adjacent liner panels into an elongated track of at least one vertical structural element.

17. The method of claim 16, wherein the first sealing material is disposed between the gypsum liner panels and the elongated track of the at least one vertical structural elements.

18. The method of claim 17, wherein the plurality of horizontal structural elements comprises a generally C-shaped sectional profile, and wherein the at least one vertical structural element comprises a generally-H-shaped sectional profile.

* * * * *